US011285084B2

(12) United States Patent
Roux

(10) Patent No.: US 11,285,084 B2
(45) Date of Patent: Mar. 29, 2022

(54) FEEDING ATTACHMENTS, FEEDING CUP AND METHODS OF USE

(71) Applicant: Gabriel Hendrik Roux, Kearneys Spring (AU)

(72) Inventor: Gabriel Hendrik Roux, Kearneys Spring (AU)

( * ) Notice: Subject to any disclaimer, the term of this patent is extended or adjusted under 35 U.S.C. 154(b) by 0 days.

(21) Appl. No.: 16/480,146

(22) PCT Filed: Jan. 19, 2018

(86) PCT No.: PCT/AU2018/050037
§ 371 (c)(1),
(2) Date: Jul. 23, 2019

(87) PCT Pub. No.: WO2018/132877
PCT Pub. Date: Jul. 26, 2018

(65) Prior Publication Data

US 2019/0336402 A1 Nov. 7, 2019

(30) Foreign Application Priority Data

Jan. 23, 2017 (AU) ..... 2017900200
Jan. 30, 2017 (AU) ..... 2017200580

(51) Int. Cl.
*A61J 7/00* (2006.01)
*A61J 9/00* (2006.01)
*A47G 19/22* (2006.01)

(52) U.S. Cl.
CPC ..... *A61J 9/006* (2013.01); *A47G 19/2266* (2013.01); *A47G 2200/048* (2013.01)

(58) Field of Classification Search
CPC ..... B65D 51/246; B65D 47/06; A61J 9/006; A61J 7/0023; A47G 19/2266; A47G 21/181; A47G 2200/048
(Continued)

(56) References Cited

U.S. PATENT DOCUMENTS 673,958 A 5/1901 Langguth
2,837,822 A 6/1958 Wille
(Continued)

FOREIGN PATENT DOCUMENTS

CN 201108272 9/2008
CN 202637511 1/2013
WO 2004092624 A2 10/2004

OTHER PUBLICATIONS

International Search Report in corresponding PCT application No. PCT/AU2018/050037, dated Mar. 29, 2018, 7 pp.
(Continued)

*Primary Examiner* — Don M Anderson
*Assistant Examiner* — Elizabeth J Volz
(74) *Attorney, Agent, or Firm* — Tredecim LLC; Sean L. Sweeney

(57) ABSTRACT

The invention relates to a feeding attachment for a feeding cup for feeding a patient with feeding difficulties. The feeding cup including a cup body for containing thickened liquid food a wall, and an exit channel. The feeding attachment includes an attachment means for removably attaching to the exit channel and a body for receipt of the thickened liquid food, via the exit channel. A control means, for control of the thickened liquid food from the exit channel is also included. In this way thickened liquid food may enter the body of the feeding attachment from the exit channel, as controlled by the control means, and the patient may take the thickened liquid food from the body of the feeding attachment without hyperextension of the neck. The invention also relates to the cup and feeding attachment together and methods of use.

19 Claims, 15 Drawing Sheets

(58) Field of Classification Search
USPC ..... 220/703, 717; 215/387; 222/191
See application file for complete search history.

(56) References Cited

U.S. PATENT DOCUMENTS

| | | | | |
|---|---|---|---|---|
| 4,091,965 | A * | 5/1978 | Gebhard | A61J 7/0023 222/192 |
| 4,957,226 | A | 9/1990 | Pacia | |
| 5,137,183 | A * | 8/1992 | Mikulec | A61J 7/0023 222/192 |
| 5,462,101 | A | 10/1995 | Mouchmouchian | |
| 7,431,175 | B2 | 10/2008 | Helios | |
| 8,020,303 | B1 * | 9/2011 | Marsh | A47G 21/004 30/324 |
| 2014/0252012 | A1 | 10/2014 | Wharton | |

OTHER PUBLICATIONS

Written Opinion in corresponding PCT application No. PCT/AU2018/0500377, dated Mar. 29, 2018, 9 pp.

International Preliminary Report on Patentability in corresponding PCT application No. PCT/AU2018/050037, dated May 20, 2019, pp. 24.

Maddak Complete Catalog 2011 [retrieved from internet on Feb. 5, 2016] URL:http://www.maddak.com/images/catalog_thumbs/maddak_catalog.pdf> Drinking Chapter see pp. 53-59; published on Oct. 27, 2011 as per Wayback Machine.

Instructions Drinking Aid with Flow Regulator, part No. 74581-0000, was published on Nov. 3, 2011 as per Wayback Machine and retrieved Feb. 16, 2017. URL:http://www.maddak.com/pdf/745810000.pdf.

Supplemental European Search Report in corresponding application No. EP 18741712.6, dated Nov. 14, 2019, 4 pp.

Indian Examination Report in corresponding application No. 201917032743, dated Jul. 6, 2021, 8 pp.

European Examination Report in corresponding application No. EP 18741712.6, dated Feb. 12, 2020, 6 pp.

Chinese Office Action in corresponding application No. 201880020551.0m, dated Oct. 23, 2020, 14 pp.

* cited by examiner

FEEDING ATTACHMENTS, FEEDING CUP AND METHODS OF USE

FIELD OF THE INVENTION

The present invention relates to feeding cup attachments, and in particular to feeding cup attachments for feeding patients with feeding difficulties.

BACKGROUND OF THE INVENTION

The invention relates to feeding attachments for feeding cups subject of provisional patent application and international patent application for a Geriatric Cup Feeder and Method of Use PCT/AU2011/1621 the contents of both of which is incorporated herein by reference. Further, subsequent Australian patent application number 2016202017 for a Multi-angle Feeding Cup is also incorporated herein by reference. The subject invention uses the same or similar cup arrangement with different feeding attachments for use with patients with different feeding needs, due early or intermediate stage dysphagia. The prior art cup arrangement is directed to advanced stage dysphagia.

Feeding of patients with serious other health issues can be a problem, for example the elderly or other patients with dysphagia. Dysphagia is caused by several medical conditions for example, stroke, dementia, cerebral palsy and several degenerative neurological conditions. The disability in dysphagia is expressed as an incomplete or dysfunctional swallowing mechanism that result in aspiration (inhalation of food), dehydration and malnutrition. Taking normal solids and liquids for a patient with dysphagia is a high-risk endeavour due to the risk of aspiration and can result in asphyxia (inability to breathe), pneumonia (lung infections) and ultimately, death. The industry standard to address the problem is to feed patients with dysphagia thickened fluids (low particular content, high viscosity liquid food). High viscosity liquids impose problematic flow dynamics. The high inertia of thickened liquids when taken out of a cup necessitates hyperextension of the neck. Hyperextension of the neck dramatically worsens the problem of dysphagia by further decreasing the effectivity of the swallowing mechanism and increasing the risk of aspiration and the complications of aspiration.

Feeding requires carefully adapted thickened foods, and volume and flow control to effectively and safely the feed these patients, as achieved by the previous inventions referenced above. However, it has been found that patients in the early or intermediate stages are more suited to alternative feeding methods, such as use of a spoon or to sip the liquid foods. Further, in these patients there is some stigma attached to use of the feeding cup of the previous inventions, if alternative methods may be used instead.

Dysphagia or disabled swallowing, constitutes a grey-scale symptom complex. The initial stages might present with mild drooling of saliva, slightly slow articulation or increased clearing of the throat when talking. Typically this is followed by "feeding fatigue" with decreased swallowing frequency and food residues remaining in the mouth and pharynx after swallowing. In the later stages and end of dysphagia the patient would easy choke on food, fluids and saliva, aspirate small amounts and typically develops frequent aspiration pneumonia's.

A dysphagia grading system gives a scale of 0 to 5, where 0 is able to swallow all foods without difficultly, 1 able to swallow solid foods with some difficulty, 2, able to swallow soft or semi-liquefied foods only, 3 able to swallow liquefied foods and liquids only, and 4 unable to swallow liquid or saliva.

Because of the often subtle and prolonged onset of the disability, the diagnosis is usually not made until complications set in. The initial "soft symptom complex" makes it also possible for the patient to hide his symptoms due to fear of social embarrassment. It is estimated that 75% of patients with dysphagia remains undiagnosed due to the subclinical onset of the disability and the masking of symptoms during the early stages of the disability.

The target during this third phase of device development is to build on the basic RoseCup (Trade Mark) cup-design of the inventor (that so effectively conquers the complicated flow dynamics of thickened fluids for the dysphagic patient), by modifying the delivery mechanism to:

1. Ease the feelings of stigmatisation and enhance uptake in the early stages of the disability.
2. The device modification attempt to recognise the grey scale symptomatology and develop a device more specific to the different stages and grades of the disability.
3. The innovation target cost savings and enhancing compliance by using the same core device but introducing interchangeable mouthpieces. This will allow the patient and his carer to adjust his device to suit the incumbent stage of his disability.
4. The innovation further introduces two valve types to enhance safety for patients who are reluctant or unable to transfer to suck-based swallowing.
5. The innovation also attempts to address the complicated middle and late stages of pseudo bulbar palsy.

It is expected that a stage-based exposure to the management of the disability would render upgrading to the ultimate safety and efficiency of a suck-based application (current RoseCup (Trade Mark) configuration) much better tolerated by the patient. Easing into a progressive device-based program would involve an intuitive adjustment to an already familiar device.

Finally is it is expected that suck-based swallowing (tongue-suck) in the dysphagic patient has a rehabilitative benefit. For example, introducing the soft spout earlier in the disability might slow down and even temporarily reverse the progression of the disability. However, more research and development has to be done to prove this hypothesis. Offering a low stigma RoseCup (Trade Mark) option specific for early stages of dysphagia by means of a "Drinking Spoon" and a modified "Sip Mechanism" as described below for the subject invention, should facilitate the early introduction of suck-based swallowing (tongue-suck) with the associated benefits.

Drinking out of a normal cup imposes the problem of high-risk neck extension for the patient with all stages of dysphagia. The patient has to extend the neck to empty the cup. Drinking high viscosity thickened fluids out of a normal cup exacerbates the problem by demanding a further increase in the angle of neck extension.

The subject invention introduces the use of inventive feeding attachments with flow control for attachment to the exit channel of the previously designed RoseCup (Trade Mark). The subject invention, in one form enables a patient with early stages of dysphagia to use a spoon-method of feeding thickened fluids in a constant drinking action—without extending the neck. In other forms a valve arrangement can be used with a sipper feeding attachment to control the flow of the thickened liquid food.

For early or intermediate stage dysphagia patient, the subject invention provides a significant new option, when compared to the prior art, as described in detail below. As well as providing an entry use of feeding methods without stigma which can be upgraded as the patient needs greater assistance to feed.

The following describes a non-limiting example of the invention being used with reference to feeding a thickened liquid food to an adult patient as a useful example. Clearly, the invention may be used for any suitable patient where it may benefit for use to feed the patient.

For clarity, any prior art referred to herein, does not constitute an admission that the prior art forms part of the common general knowledge, in Australia or elsewhere.

It is an object of the present invention to provide a feeding attachment for a feeding cup that at least ameliorates one or more of the aforementioned problems of the prior art. It is a further object of the present invention to provide a feeding cup with feeding attachment that at least ameliorates one or more of the aforementioned problems of the prior art. It is another object of the present invention to provide a method of use of a feeding attachment for a feeding cup that at least ameliorates one or more of the aforementioned problems of the prior art.

DISCLOSURE OF THE INVENTION

Accordingly, the present invention provides a feeding cup attachment for feeding thickened liquid foods to patients with feeding difficulties, the feeding cup including a substantially rigid container with an exit channel, the feeding cup attachment including:

- an attachment means removably attachable to the exit channel of the feeding cup;
- a substantially "spoon" shaped body with holding cuff, connected to the attachment means, and adapted to receive a suitable volume of thickened liquid food in a controlled manner from the exit channel of the feeding cup; and
- a control means including a valve arrangement, for control of the flow from the exit channel into the "spoon" shaped body of the feeding attachment, wherein, the thickened liquid food enters the body of the feeding attachment from the exit channel, as controlled by the valve arrangement and the patient is fed the thickened liquid food from the "spoon" shaped body without hyperextension of the neck of the patient, and the holding cuff assists to maintain the volume of thickened liquid food in the body.

Preferably, the feeding attachment is one of a stepped program of options used to feed patients with different grades of dysphagia. Most preferably, a patient may start with a feeding attachment with an appearance of a spoon, for reduced stigma. As the feeding disability progresses the feeding attachment can be changed to one suitable for the grade of dysphagia. The feeding attachments may take any suitable form.

Preferably, the feeding cup is the feeding cup of the inventor's design. Preferably, the feeding cup is the feeding cup of the previous Australian patent application number 2016202017, in any of its form or variants.

Preferably, the feeding is assisted feeding of a patient who cannot safely feed themselves. The degree of ability to feed themselves may vary and the type of feeding attachment adjusted. The feeding attachments of the invention may be suitable for early stage dysphagia. The feeding attachments of the invention may be suitable for intermediate stage dysphagia.

The patient may be any patient who would benefit from use of the invention in any of its forms or variants. The patient may be an adult patient. The patient may have significant feeding difficulties eg dysphagia. The dysphagia may be early stage or intermediate stage. The feeding difficulties may be permanent and degenerative, as in the case of an elderly person or person with dementia. The feeding difficulties may be temporary and improving such as post-operatively.

Preferably, the cup body is adapted to contain a suitable quantity of thickened liquid food to feed a patient. Preferably, the exit channel is adapted to include a large opening from the body to receive the thickened food. Preferably, the exit channel is angled suitable to enable feeding in a range of angles. Preferably, the exit channel has an angle of substantially 25 to 45 to the vertical. Preferably, the cup with feeding attachment can be used to feed a patient at any suitable positional angles. Preferably, the cup and feeding attachment can be used to feed a patient at all suitable positional angles. The angles of feeding may include those suitable to feed a patient where the patient is sitting, lying, or reclining.

Preferably, a health worker recommends a suitable thickness of liquid food for a particular patient. The thickened liquid food may be products sold under the brand NutriTaste (Trade Mark). The thickened liquid food may be made up to standardised thicknesses. The standardised thicknesses may be determined by the industry. Preferably, the standardised thickness is: "Level 150", mildly thick where fluid flows but will coat a spoon; "Level 400", moderately thick, would drop off a spoon in dollops, rather than running; and "Level 900", extremely thick, where there is no flow and the liquid food would remain on a tilted spoon. There may be coordinated colour coding of the level of thickness to be fed and the mouth piece of the cup, to facilitate use. Most preferably, consistent colour coding is used for the mouth piece and food packaging for a particular level of standardised fluid thickness. These colours may be determined by the industry as standardised colours denoting thickness. The feeding attachment and thickness of the thickened liquid food will all be determined by the feeding ability of the patient and suitably chosen.

The thickened liquid food could, perceivably be replaced with other liquids. The invention may be used to feed other fluids if suitable and safe to do so.

The wall is part of the cup in the usual manner, and the exit channel extends from the wall, preferably, at a suitable angle for feeding.

Preferably, the exit channel includes a large opening to enable thickened liquid food to flow easily into the channel. Preferably, the channel is wide to enable ready flow. The opening to the exit channel may be at least 22 millimetres wide. The opening to the exit channel may be between substantially 22 and 55 millimetres wide.

Preferably, the exit channel is angled to facilitate flow at different angles. Preferably, the exit channel extends at an angle in the range of substantially 25 to 45 degrees to the vertical. Most preferably, the exit channel extends at an angle of substantially 30 degrees to the vertical. Use of 30 degrees has been found to be most advantageous. Preferably, the exit channel extends from the base of the cup at substantially 30 degrees to the vertical and has an opening and exit of at least 20 millimetres width.

Preferably, three handles are included to enable the patient and carer a wide choice of holds. The patient and carer may both hold the cup to facilitate safe feeding.

Preferably, a lid is included and the cup is substantially sealed during use to prevent loss of thickened liquid food other than through the feeding attachment.

Preferably, the feeding attachment is readily attached or removed from the cup, so as to be easy to use for the carer. The attachment of the feeding attachment to the cup may be through any suitable means. The attachment may be through means chosen from the following group: push fit; screw fit; or clip on. A positioning indicator may be included such a mark to show when the feeding attachment has been suitably screwed onto the exit channel of the cup. Preferably, the feeding attachments screw on to the end of the exit channel. Preferably, thickened liquid food can leave the cup through the exit channel into the feeding attachment. Preferably, the feeding attachment enables a patient to feed through the feeding attachment from the cup. The feeding attachment may be a single piece or made in several parts assembled together before use.

The attachment means may take any suitable form. Preferably, the end of the exit channel of the cup is adapted to correspond to the attachment means so that they fit together. The adaptation may be inclusion of screw thread on the end of the exit channel on to which the attachment means of the feeding attachment screws before use. Alternatively, corresponding parts for a push fit may be included at the end of the exit channel and the feeding attachment. Other forms of corresponding parts to firmly attach the feeding attachment to the exit channel in use may be used instead. Other forms of cup may be used and in these forms of invention the feeding attachment may attach to any suitable part of the cup so that the thickened liquid food fed to the patient. Most preferably, the exit of the exit channel is covered by the feeding attachment in use so thickened liquid food may be fed there from. In a different form of the invention the cup may be replaced with a vessel that communicates directly to the feeding attachment, without a separate exit channel. In this inferior form of the invention the control means controls flow directly from the container to the feeding apparatus.

Preferably, the removable attachment is suitable to be maintained in place during use and readily removed after use. A more permanent arrangement may be used in inferior forms of the invention. It is highly beneficial to be able to interchange feeding attachments to the same cup for different feeding abilities. Most preferably, the feeding attachment can be readily removed and replaced as required by a carer to feed a patient. Most preferably, a range of feeding attachments are available which may be used with the cup, chosen or the feeding ability or disability of the patient.

The body of the feeding attachment may take any suitable shape or form. Preferably, the body includes a neck and it is at the neck that attachment of the feeding attachment is made to the exit channel.

Preferably, in one form of the invention the body includes a spoon part that resembles the bowl of a spoon. In this form of the invention the stigma associated with the use of the feeding attachment is reduced as it is closer to use of conventional feeding methods. Preferably, the body includes a spoon-part from which a patient can feed. Preferably, the spoon-part is adapted to hold a suitable volume of thickened liquid food for safe feeding.

Preferably, the spoon-part is adapted to be suitable to fit comfortably in the mouth of a patient. Preferably, the spoon-part is adapted to be suitable to fit comfortably in the mouth of an adult patient. Preferably, the spoon-part is adapted to avoid spilling. Preferably, the spoon-part has sides suitable to assist to maintain the thickened liquid food in the spoon during feeding. Preferably, the sides of the spoon are raised to assist to contain the food until taken by the patient. The size and shape of the spoon bowl may be varied slightly.

Most preferably, the body is adapted to hold rather than spill its contents if feeding is interrupted. Most preferably, a holding cuff arrangement is included in the body. Preferably, the holding cuff arrangement is adapted to hold the volume of thickened liquid food of the body in use. Preferably, the holding cuff assists to hold the volume of thickened liquid food in the body of the feeding attachment when the attached feeding cup is placed on a flat surface, until feeding commences again. Preferably, the holding cuff arrangement assists to hold the volume of thickened liquid food when the cup is placed on a surface. In other words, when the flat spoon is returned to an angled position the holding cuff arrangement can take the thickened liquid food and hold it, until feeding commences again. An ordinary spoon when tipped from the horizontal would tip the food or the food would spill out. Instead and advantageously, the holding cuff arrangement accommodates the volume to be held safely. In one form the material of the holding cuff arrangement is suitable to expand slightly when full to help to contain or hold the volume of thickened liquid food.

The holding cuff may take any suitable form. The holding cuff arrangement may be an expansion at the upper part of the body. The holding cuff arrangement may be shaped part at the upper edge of the body, not in use during feeding but if the body is tipped the holding cuff can accommodate the volume of the spoon part substantially without spilling. The expansion may not be filled with thickened liquid food when the feeding attachment is used to feed but can fill when tilted, such as to be placed on a flat surface. Most preferably, when feeding is interrupted the volume of thickened liquid food is maintained in the holding cuff and gradually returned to the cup, if feeding does not recommence. The slow return enables feeding to recommence quickly as the food will mostly be still in the feeding attachment. The holding cuff arrangement is a useful addition to enable feeding to stop and start without loss of the food, which may be a monitored volume, and to recommence quickly. The slow return of the food to the cup may be via the control means.

The spoon-like adaptation is useful as the stigma is reduced but also for the ease of use and as an entry level feeding attachment which can then assist to move patients on to other feeding attachments later if more advanced dysphagia is found.

Alternatively to the spoon-like attachment a sipper attachment may be used instead. The sipper attachment may include a body with a spout on which a patient can suck. Lip sucking can draw thickened liquid food to the patient from the cup via an aperture. Preferably, the spout is generally in the form of downward curve. Preferably, the aperture is wide. Preferably, the aperture is adapted to enable thickened liquid foods to be sucked from the cup, the sucking controlling the flow and volume. Preferably, the sipper attachment is included with a body with a spout, with a wide aperture in the form of a downward facing curve, on which a patient can suck and lip sucking can draw thickened liquid food to the patient from the cup via the aperture.

Other forms of body may be included instead, suitable to feed patients. These forms of body may be used with the valve arrangements of the invention described below. The sipper attachment may be used with the valve arrangements of the invention described below.

The control means may take any suitable form. The control means may include one or more part. The control means may form part of the rest of the feeding apparatus eg attached to the body. The control means may be a separate part of the feeding apparatus, separate from the body but used together to control the flow of thickened liquid food from the exit channel of the cup. More than one control means may be used. More than one control means may be included, including one as forming part of the body and one as a separate control means. Preferably, the control means is associated between the exit channel and the body of the feeding apparatus such that the flow of thickened liquid food is controlled. Most preferably, the flow of the thickened liquid food is slowed by the control means.

In one form of the invention the control means includes a wall and inlet between the exit channel and the body of the feeding attachment. Preferably, the wall substantially prevents flow from the exit channel excepting through the inlet. In this form of the invention this may be the valve arrangement of the control means. The inlet may take any suitable size or shape to control the flow of thickened liquid food. Most preferably, the inlet is curved. Most preferably, the inlet is adapted to suitable slow the flow of thickened liquid food from the cup through the exit channel into the body of the feeding apparatus for feeding of the patient. Preferably, the inlet is positioned at the lower part of the feeding apparatus. In this form of the invention the flow of thickened liquid food is significantly slowed by the control means. Preferably, creation of a wave of liquid is prevented by use of the control means to improve the safe feeding for the patient. Preferably, the flow is impeded by the control means. The flow of thickened liquid food may be impeded by the control means to substantially prevent over filling or spilling. The control means may enable or control flow in either or both directions. Preferably, the flow of thickened liquid food from the exit channel of the feeding cup is impeded by the valve arrangement of the control means, to substantially prevent over filling of spilling. Preferably, the curved inlet is the valve arrangement of the control means and enables slow flow in either direction. Most preferably, there is slow flow during feeding and when feeding is interrupted and the cup placed on a surface the thickened liquid food may slowly flow back into the cup, through the valve arrangement. Preferably, the flow of thickened liquid food is slowed by the valve arrangement of the control means into the body and on standing up, the thickened liquid food may slowly pass back into the cup.

The shape of the body of the feeding attachment may also assist to control the flow. The control means may include the shaping of the body. Preferably, a shaped neck part is included. Preferably, the shaped neck part assists to prevent spilling from the feeding apparatus when feeding is interrupted. The shaped neck part may be adapted to bulge or expand to contain the volume of the body of the spoon. Preferably, the shaped neck part is adapted to bulge or expand to contain the volume of the body of the spoon in an upright orientation. Other adaptations may be included to suitably assist to control the flow of liquid.

Preferably, the feeding apparatus is spoon-like in overall appearance and includes a wall to substantially prevent flow of thickened liquid food from the exit channel except through a curved inlet. Preferably, in this form of the invention a shaped holding cuff attachment is included whereby if feeding is interrupted and the feeding attachment tipped up, the thickened liquid fluid is held by the neck to prevent spilling.

The control means may include the shaping of a spout adapted for feeding thickened liquid food. The control means may be a shaping of the opening to the exit channel.

The control means may include one or more valve. One or more valve arrangement may be included in the feeding attachment or for use with the feeding attachment. Any suitable form of valves may be used. Any suitable number of valves may be used.

Preferably, in one form of the invention, the valve arrangement is used with a simple feeding attachment spout and the valve arrangement is the control means used to control the flow of the thickened liquid food. The valve arrangement may take any suitable form. The valve arrangement may be adapted to fit in the exit channel of the cup. Preferably, the valve arrangement is adapted to fit within the cup and be in fluid communication with the body of the feeding attachment to control flow. Variations to the exact placement and fitting of the valve arrangement may be made. Most preferably, the exit channel of the cup is angled and the valve arrangement is adapted to be similarly angled. Preferably, the exit channel is tapered and the valve arrangement is correspondingly tapered to fit within the exit channel in use.

Preferably, the valve arrangement is adapted to correspond to fit with the exit channel. Most preferably, the valve arrangement is adapted to correspond and fit with an angled exit channel. Preferably, a valve body is included. Preferably, a first valve is included in the valve body. The first valve may be a cover adapted to cover the opening of the valve arrangement to the exit channel to prevent flow back into the cup. Preferably, the cover is a ball adapted to close the opening to the cup when in place. In this form of the invention the cover or ball is held in place under gravity and readily moved on tipping of the cup. Alternatively, sucking of the liquid can open the valve. In use the ball is movably through use of tipping and gravity or the lip-suck action on thickened liquid fluid, in a similar means to sucking on a straw. When the ball returns to block the flow, additional thickened liquid fluid no longer enters the exit channel. Preferably, the first valve is a ball valve. Preferably, the ball valve acts at the opening of the body of the cup to the exit channel. Preferably, the ball valve acts at the lowest point of the exit channel close to the base. Preferably, the valve arrangement is adapted to prevent the ball leaving the channel or valve body. The adaptation may be a narrowing of the first valve body to prevent the ball leaving. A safety ring may be include in the valve body to prevent the ball, or other parts of the valve leaving the valve body and exit channel towards the feeding attachment.

Preferably, a second valve is included in the valve body. The second valve may take any suitable form. Preferably, a cross slit is included and thickened liquid food may pass in one direction from the exit channel into the feeding attachment through the cross slit. Any suitable valve arrangement to slow or control the flow may be used instead. Preferably, the second valve is a cusp valve. Slow return of the fluid through the cusp valve may be possible, when the feeding is interrupted, for example.

Most preferably, in one form of the invention, the valve arrangement includes both the first and second valves to control the flow of the thickened liquid food. For example, the attachment may extend into the exit channel of the feeding cup so that the first valve controls flow into the exit channel and the second valve controls the flow out of the exit channel. In other forms of the invention the valve body may be omitted and one or more valves installed directly in the exit channel. However, it is most preferable to include a valve body with one or more valve for convenience of use. Most preferably, a valve arrangement is associated with the entrance of the exit channel. Most preferably, a valve arrangement is associated with the exit of the exit channel. Preferably, the valve arrangement includes a valve associated each with the entrance and exit of the exit channel for control of the flow of thickened liquid food.

Preferably, the feeding minimises the risk of spitting, or aspiration by the patient when feeding. Preferably, hyperextension of the neck is substantially avoided throughout feeding. Preferably, hyperextension is avoided through use of the inventive feeding attachment, in any of its forms or variants. Preferably, the feeding may be at substantially any positional angle.

Accordingly, the present invention provides, in a variant, a feeding attachment for a feeding cup for feeding a patient with feeding difficulties, the feeding cup including a cup body for containing thickened liquid food and including a wall, an exit channel whereby the thickened liquid food can leave the cup, the feeding attachment including:

an attachment means for removably attaching to the feeding cup exit channel;

a body for receipt of the thickened liquid food from the cup, via the exit channel, the body including a spoon-part and a holding cuff arrangement;

a control means including a valve, for control of the thickened liquid food from the exit channel, wherein, thickened liquid food may enter the body and the spoon-part of the feeding attachment from the exit channel, as controlled by the control means and valve, and the patient may take the thickened liquid food without hyperextension of the neck and further wherein when feeding is interrupted the holding cuff arrangement substantially maintains the thickened liquid food in the feeding attachment when the cup is placed on a flat surface.

Accordingly, the present invention also provides a multi-angle feeding cup and feeding attachment for feeding thickened liquid food to a patient, the cup including:

a cup body for containing the thickened liquid food, and including a wall;

an exit channel extending at an angle from the wall;

a feeding attachment including an attachment means for removably attaching to the feeding cup exit channel, a body for receipt of the thickened liquid food from the cup, via the exit channel and a control means for control of the thickened liquid food from the exit channel, wherein, thickened liquid food may enter the feeding attachment body as controlled by the control means from the exit channel of the feeding cup and the patient may take the thickened liquid food, without hyperextension of the neck.

Preferably, the multi-angles of feeding are any angle of feeding. The angles of feeding may be vertical facing upwards. The angle of feeding may be vertical facing downwards. The angle of feeding may be any angle within the 180 degrees between vertical facing upwards and vertical facing downwards. The angles may be at any angle suitable to feed an adult patient. In an inferior form of the invention flow in one or more particular direction or use in one or more tilt direction may be prevented.

The multi-angle feeding cup may be used to feed any suitable liquid, of a thickness to be controlled by the mouth piece. Preferably, the multi-angle feeding cup is used to feed thickened liquid food. The thickened liquid food is preferably of a form of predicable nutritional value once made up, to enable monitoring of feeding of the patient. Any suitable fluid food may be used with the inventive cup. However, it is beneficial to use the multi-angle cup with prescribed thicknesses of liquid food, suitable for the particular patient. The particular food and thickness may be determined by a health professional as most suitable. It is advantageous that use of the multi-angle cup and standardised thicknesses of liquid enables a health professional to have certainty as to the thickness of food fed, which can be adjusted reliably therefore, as the patient's ability to feed changes.

Preferably, the patient may have early or intermediate dysphagia. The patient may be a dementia patient. The patient may be an elderly person. The patient may be any adult with difficulty feeding. The patient may be a neurologically compromised person, including a young adult.

Preferably, the cup is manufactured in one or more parts and supplied to the carer for assembly and use. The cup may be provided in kit form with a ranges of suitable mouth pieces. The range of suitable feeding attachments may be one each suitable for Level 150, Level 400 and Level 900. A sample kit may also be provided with samples of suitable foods to make up to Level 150, Level 400 and Level 900 to correspond to the feeding attachments. In this way a carer has access to a full range of options, in one handy pack.

The cup body and exit channel may be made of a rigid material. Preferably, a suitable plastics material is used. Preferably the cup body and exit channel are made substantially of an Acrylonitrile butadiene styrene ("ABS") plastics material. Parts of the cup may be made of thermoplastic elastomers ("TPE"). Parts of the cup may be made of silicone. The cup and its parts may be made of any suitable materials and combination of materials.

Preferably, a rigid cup body is included. The cup body may be any suitable size and shape to contain thickened liquid food. Preferably, the body of the cup has a base and the wall extends up from the base to form the cup body for containing liquid. Preferably, the wall extends out from the floor at an angle. The cup may be any suitable shape. In other forms of the invention there may be more than one wall, such as in a square based cup. Preferably, the base of the cup is substantially stable when placed on a flat surface. Preferably, the base of the cup may be substantially flat. Preferably, the base of the cup is substantially circular and the wall extends up and out from the substantially circular base.

Preferably, the cup body is made of a rigid plastics material. The cup body is preferably made of a strong usable plastics material that is readily cleaned.

Preferably, the cup body is configured to contain a suitable volume of thickened liquid food to feed an adult patient. The thickened liquid food may be any of the proprietary NutriTaste (Trade Mark) products as detailed above. Preferably, a lid is included to the cup body to enclose the top thereof. The lid may take any suitable form. Preferably, the lid seals tight to prevent loss of fluid during use. The lid may be substantially circular and screw onto a corresponding circular top of the cup. Other forms of lid and seal may be included.

Preferably, more than one handle is included. Preferably, more than two handles are included. Preferably, there are three handles extending out from the cup. Preferably, the handles extend from the wall of the cup body. In other forms of the invention the handles may be attached to the base and or lid instead. Preferably, the handles are attached to two points of the multi-angle cup for improved hold. Preferably, three handles are included, one on either side of the exit channel and one to the rear. Preferably, the handles are spaced at 90 degrees to either side of the exit channel with the rear handle spaced 90 degrees from the other two. Most preferably, the three handles enables ready use of the multi-angle cup in any direction with a choice of multiple holds. Preferably, the patient and or carer can hold the multi-angle cup through use of one or more of the handles. Preferably, both the patient and the carer can hold the cup at the same time through use of the handles. A patient may hold the cup while a carer maintains contain with a handle in case that grip is lost. There are a multitude of angles, and options of hold with the subject inventive multi-angle cup. Preferably, grip is included on the handle. The grip may be a silicone grip.

Reinforcement or shaping may be included in any parts of the cup body to assist manufacture or for the multi-angle cup to maintain integrity through extended use.

The wall is preferably a smooth wall extending from the base towards a top of the cup. The wall may be any suitable thickness. Preferably, the wall is rigid and of a suitable thickness to resist deformation under pressure.

Preferably, the exit channel is made of a rigid plastics material. Preferably, the exit channel is made of an Acrylonitrile butadiene styrene ("ABS") plastics material. Other suitable plastics may be used instead. Preferably, the exit channel extends from the wall of the cup towards a base. Preferably, the exit channel extends from the wall of the cup at the base. Preferably, the exit channel extends from the base of the cup to be substantially level with a top of the cup. Preferably, the exit channel is a wide channel with a large opening with the body of the cup. Preferably, the wide opening of the exit channel with the body of the cup is at least 20 millimetres wide. Preferably, the wide opening of the exit channel with the body of the cup is at least 22 millimetres wide. Most preferably, the opening of the body of the cup with the exit channel has dimensions of substantially 22 millimetres by 55 millimetres.

Preferably, the exit of the exit channel to the mouth piece is at least 20 millimetres wide. Preferably, the exit of the exit channel to the mouth piece is at least 22 millimetres wide. Other suitable wide sizes of opening and exit may be used. The size is important to enable the thicker levels of thickened level food to be fed.

Preferably, the exit channel extends at an angle in the range of substantially 25 to 45 degrees to the vertical. Most preferably, the exit channel extends at an angle of substantially 30 degrees to the vertical. Use of 30 degrees has been found to be most advantageous. Preferably, the exit channel extends from the base of the cup at substantially 30 degrees to the vertical and has an opening and exit of at least 20 millimetres width.

Preferably, feeding attachments may be interchangeably attached to the exit channel. Preferably, the feeding attachment of the cup is a feeding attachment of the invention in any of its form or variants.

Preferably, the exit channel and feeding attachment together form an angled spout for beneficial controlled delivery of thickened liquid food for an adult patient. Preferably, the exit channel and feeding attachment together form a feeding cup that may be used at substantially any positional angle to feed a patient.

Accordingly, the invention also includes a valve arrangement for use with a feeding cup, including a body adapted to fit within the spout of a feeding cup with an opening in fluid communication with fluid in the body of the cup and, also in fluid communication with an exit through which a patient may be fed, and including at least one valve to control the flow of fluid from the cup to the exit. The valve arrangement may therefore be used with different cups and different feeding attachments, and still control the flow of fluid. Preferably, the valve arrangement is adapted to correspond to fit with the exit channel of the prior art cup of the inventor. Most preferably, the valve arrangement is adapted to correspond and fit with an angled exit channel. Preferably, a valve body is included. Preferably, a first valve is included in the valve body. The first valve may be a cover adapted to cover the opening of the valve arrangement to the exit channel to prevent flow back into the cup. Preferably, the cover is a ball adapted to close the opening to the cup when in place. In this form of the invention the cover or ball is held in place under gravity and readily moved on tipping of the cup. Alternatively, sucking of the liquid can open the valve. In use the ball is movably through use of tipping and gravity or the lip-suck action on thickened liquid fluid, in a similar means to sucking on a straw. When the ball returns to block the flow, additional thickened liquid fluid no longer enters the exit channel. Preferably, the first valve is a ball valve. Preferably, the ball valve acts at the opening of the body of the cup to the exit channel. Preferably, the ball valve acts at the lowest point of the exit channel close to the base. Preferably, the valve arrangement is adapted to prevent the ball leaving the channel or valve body. The adaptation may be a narrowing of the first valve body to prevent the ball leaving. A safety ring may be include in the valve body to prevent the ball, or other parts of the valve leaving the valve body and exit channel towards the feeding attachment.

Accordingly, the invention also provides a feeding cup attachment for feeding thickened liquid foods to patients with feeding difficulties, the feeding cup including a substantially rigid container with an exit channel, the feeding cup attachment including:

- an attachment means removably attachable to the exit channel of the feeding cup;
- a substantially "spoon" shaped body, connected to the attachment means, and adapted to receive a suitable volume of thickened liquid food in a controlled manner from the exit channel of the feeding cup; and
- a control means including a valve arrangement, for control of the flow from the exit channel into the "spoon" shaped body of the feeding attachment, wherein, the thickened liquid food enters the body of the feeding attachment from the exit channel of the feeding cup, as controlled by the valve arrangement and the patient is fed the thickened liquid food from the "spoon" shaped body without hyperextension of the neck of the patient.

Accordingly, the invention also provides in a variant, a feeding cup attachment for feeding thickened liquid foods to patients with feeding difficulties, the feeding cup including a substantially rigid container with an exit channel, the feeding cup attachment including:

- an attachment means removably attachable to the exit channel of the feeding cup;
- a body with holding cuff, connected to the attachment means, and adapted to receive a suitable volume of thickened liquid food in a controlled manner from the exit channel of the feeding cup; and
- a control means including a valve arrangement, for control of the flow from the exit channel into the body of the feeding attachment, wherein, the thickened liquid food enters the body of the feeding attachment from the exit channel of the feeding cup, as controlled by the valve arrangement and the patient is fed the thickened liquid food from the body without hyperextension of the neck of the patient, and the holding cuff assists to maintain the volume of thickened liquid food in the body.

Accordingly, the invention provides in a further variant, a feeding cup attachment for feeding thickened liquid foods to patients with feeding difficulties, the feeding cup including a substantially rigid container with an angled exit channel, the feeding cup attachment including:

an attachment means removably attachable to the exit channel of the feeding cup;

a substantially "spoon" shaped body with holding cuff, connected to the attachment means, and adapted to receive a suitable volume of thickened liquid food in a controlled manner from the exit channel of the feeding cup; and a control means for control of the flow from the exit channel into the "spoon" shaped body of the feeding attachment, wherein, the thickened liquid food enters the body of the feeding attachment from the exit channel of the feeding cup and the patient is fed the thickened liquid food from the "spoon" shaped body without hyperextension of the neck of the patient, and the holding cuff assists to maintain the volume of thickened liquid food in the body.

Accordingly, the invention provides in another further variant, a multi-angle feeding cup and feeding cup attachment for feeding thickened liquid food to a patient, the cup including:

a substantially rigid container, for containing the thickened liquid food, and including a wall;

an exit channel, extending from the wall at an angle;

a feeding cup attachment, including an attachment means removably attachable to the feeding cup exit channel, a substantially "spoon" shaped body with holding cuff, for receipt of the thickened liquid food from the feeding cup via the exit channel and a control means, including a valve arrangement, for control of the thickened liquid food from the exit channel into the "spoon" shaped body, wherein, thickened liquid food enters the feeding cup attachment body, as controlled by the valve arrangement of the control means, from the exit channel of the feeding cup and the patient is fed the thickened liquid food from the "spoon" shaped body, without hyperextension of the neck, and the holding cuff arrangement assists to maintain the volume of thickened liquid food in the body.

Preferably, the exit channel of the feeding cup extends at an angle in the range of substantially 25 to 45 degrees to the vertical. Most preferably, the exit channel extends from a base of the feeding cup at substantially 30 degrees to the vertical and has an opening and exit of at least 20 millimetres width.

Accordingly, the invention also provides a method of use of a multi-angle cup with feeding cup attachment for feeding a patient with feeding difficulties, the multi-angle cup including a substantially rigid container including a wall, an exit channel extending from the wall at an angle, the feeding cup attachment including an attachment means to removably attach to the exit channel of the substantially rigid cup, a substantially "spoon" shaped body with holding cuff, connected to the attachment means, and a control means including a valve arrangement for control of the flow of thickened liquid food from the exit channel, the method of use of a multi-angle cup with feeding cup attachment including the following steps:

a) filling the feeding cup with a suitable thickened liquid food;

b) attaching the feeding attachment to the exit channel of the feeding cup by the attachment means;

c) tilting the feeding cup to a suitable angle for flow of thickened liquid food into the exit channel, and feeding attachment as controlled by the valve arrangement; and d) feeding the patient through use of sipping or sucking on the feeding attachment body.

Preferably, the method including the further steps of:

e) interrupting feeding by tilting the feeding cup back, wherein the holding cuff accommodates the volume of liquid substantially without spilling and the valve arrangement allows slow flow of the fluid back into the cup; and f) optionally, recommencing feeding by tilting the feeding cup again and the thickened liquid food returns to the "spoon" shaped body and the patient can continue to feed.

Accordingly, the invention also provides a method of use of a multi-angle cup for use with feeding attachment for feeding a patient, the multi-angle cup including a cup body, including a wall, an exit channel extending from the wall at an angle, and a feeding attachment for feeding the patient in a controlled manner, the method including the following steps:

a) Place thickened liquid food in the cup body;

b) Select a feeding attachment suitable to the feeding abilities of the patient;

c) Attach the feeding attachment to the exit channel of the cup;

d) Use the feeding attachment by tipping or having the patient sip or suck to cause thickened liquid food to enter the body of the feeding attachment; and e) Thickened liquid food is fed to the patient.

Preferably, the thickened liquid food is sealed in the cup through use of a lid at step a). The steps may be repeated until the patient has been fed sufficiently. The feeding attachment of the methods may be the feeding attachment of the invention, in any of its forms or variants. The multi-angle cup of the methods may be the multi-angle cup of the invention, in any of its forms or variants.

Accordingly, the invention also provides a method of use of a multi-angle cup with feeding attachment for feeding a patient, the multi-angle cup including a cup body, including a wall, an exit channel extending from the wall at an angle, and a feeding attachment for feeding the patient in a controlled manner, the feeding attachment including an attachment means to attach to the exit channel of the cup, a body and a control means for control of the flow of thickened liquid food from the exit channel, the method including the following steps:

a) filling the cup with a suitable thickened liquid food;

b) attaching a suitable feeding attachment;

c) tilting the cup to a suitable angle for the patient to feed from the feeding attachment; and d) feeding the patient through use of sipping or sucking on the feeding attachment.

Most preferably, the feeding may be at substantially any positional angle.

Accordingly, the invention also provides a method of use of a multi-angle cup with feeding attachment for feeding a patient, the multi-angle cup including a cup body, including a wall, an exit channel extending from the wall at an angle, and a feeding attachment for feeding the patient in a controlled manner, including an attachment means to attach to the exit channel of the cup, a body including a spoon part and holding cuff arrangement and a control means for control of the flow of thickened liquid food from the exit channel, the method including the following steps:

a) filling the cup with a suitable thickened liquid food;

b) attaching a suitable feeding attachment;

c) tilting the cup to a suitable angle for the patient to feed from the feeding attachment;

d) feeding the patient through use of sipping or sucking on the feeding attachment;

e) optionally interrupting feeding by tilting the cup back wherein the holding cuff arrangement accommodates the volume of liquid substantially without spilling; and f) optionally recommencing feeding by tilting the cup again and the thickened liquid food returns to the spoon part for the patient to feed.

The feeding attachment of the methods may be the feeding attachments of the invention in any of its forms or variants. Preferably, the methods enable feeding at substantially any positional angle.

INDUSTRIAL APPLICABILITY

The cup, feeding attachments and valve arrangements can all be manufactured industrially and supplied to health professionals for use.

BRIEF DESCRIPTION OF THE DRAWINGS

The invention will now be described in connection with non-limiting preferred embodiments with reference to the accompanying drawings, in which.

DETAILED DESCRIPTION OF THE INVENTION INCLUDING A BEST MODE

Figure 1:
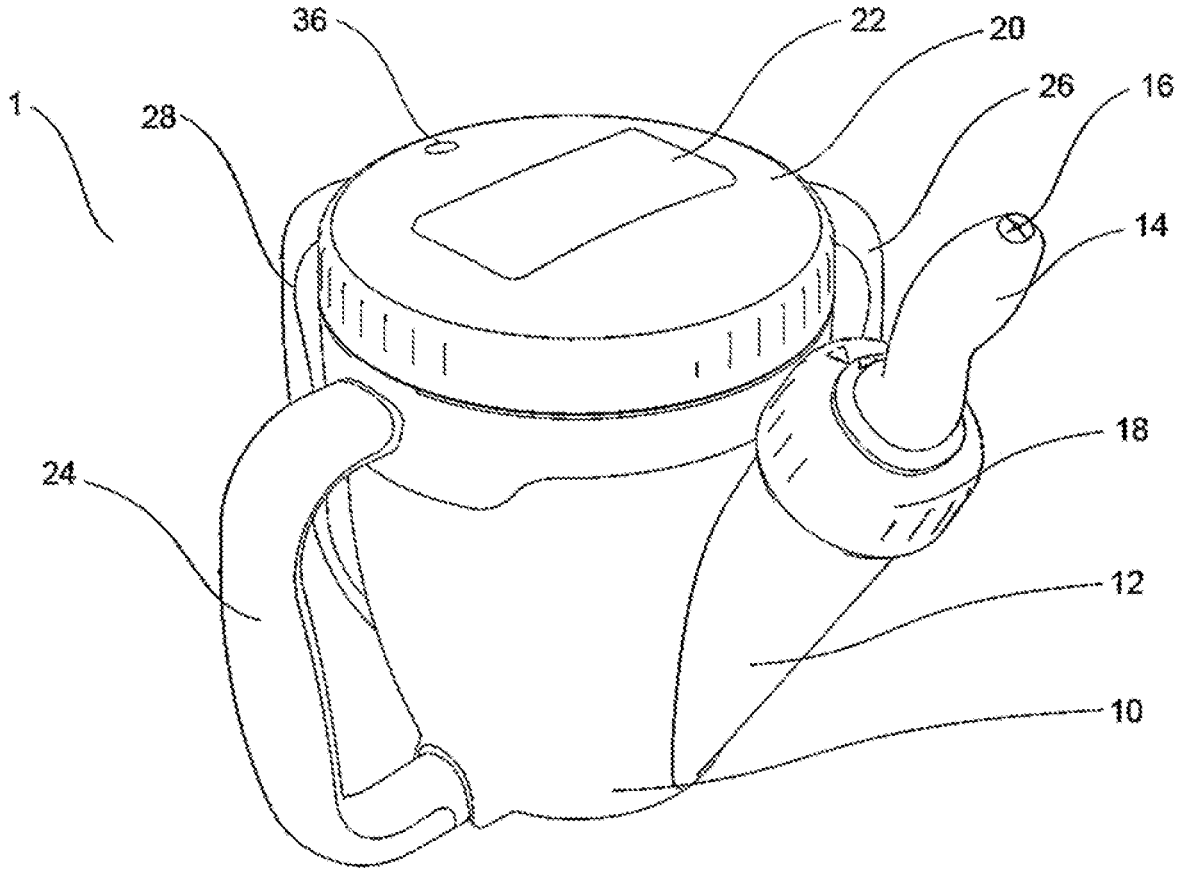
FIGURE 1 (PRIOR ART)
FIG. 1 is PRIOR ART, the feeding cup of the inventor subject of Australian patent application number 2016202017, used with the feeding attachments described herein.
Figure 2:
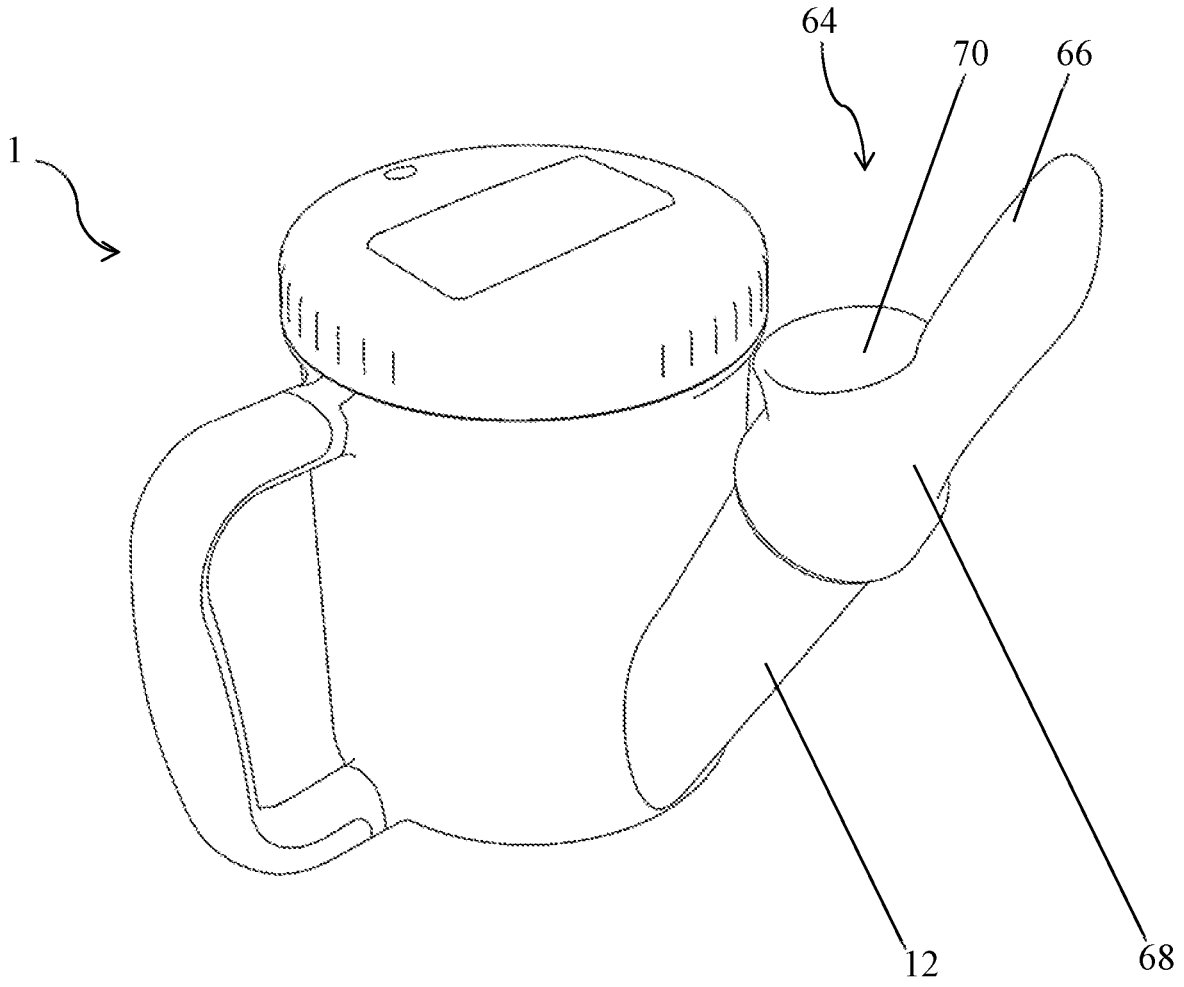
FIG. 2 is a perspective view from above of a feeding cup and feeding attachment according to a first preferred embodiment of the invention.
Figure 3:
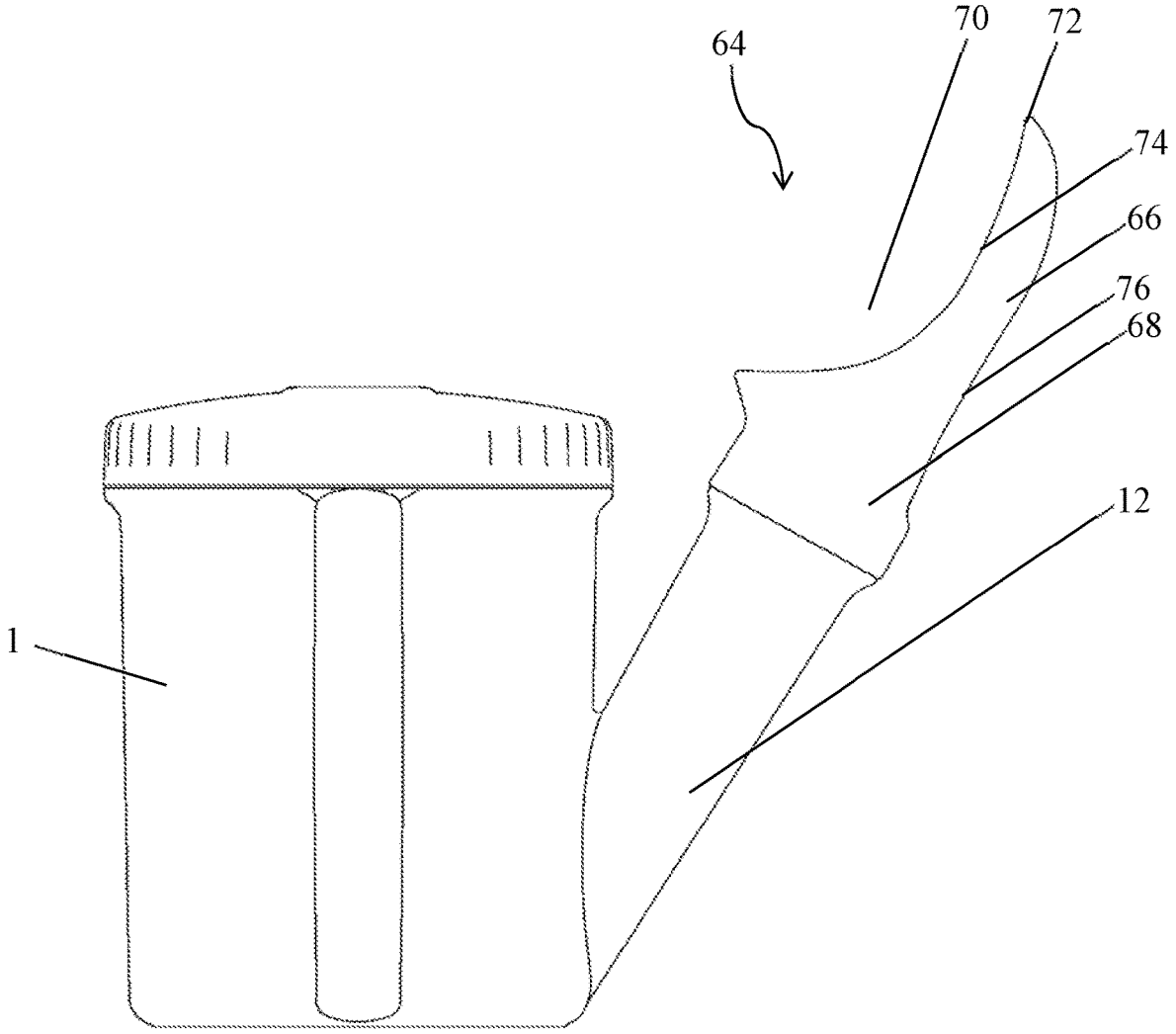
FIG. 3 is side view of the feeding cup and feeding attachment of FIG. 2 as viewed when the cup is on a flat surface, illustrating how the holding cuff can hold the volume from the spoon-part in this position.
Figure 4:
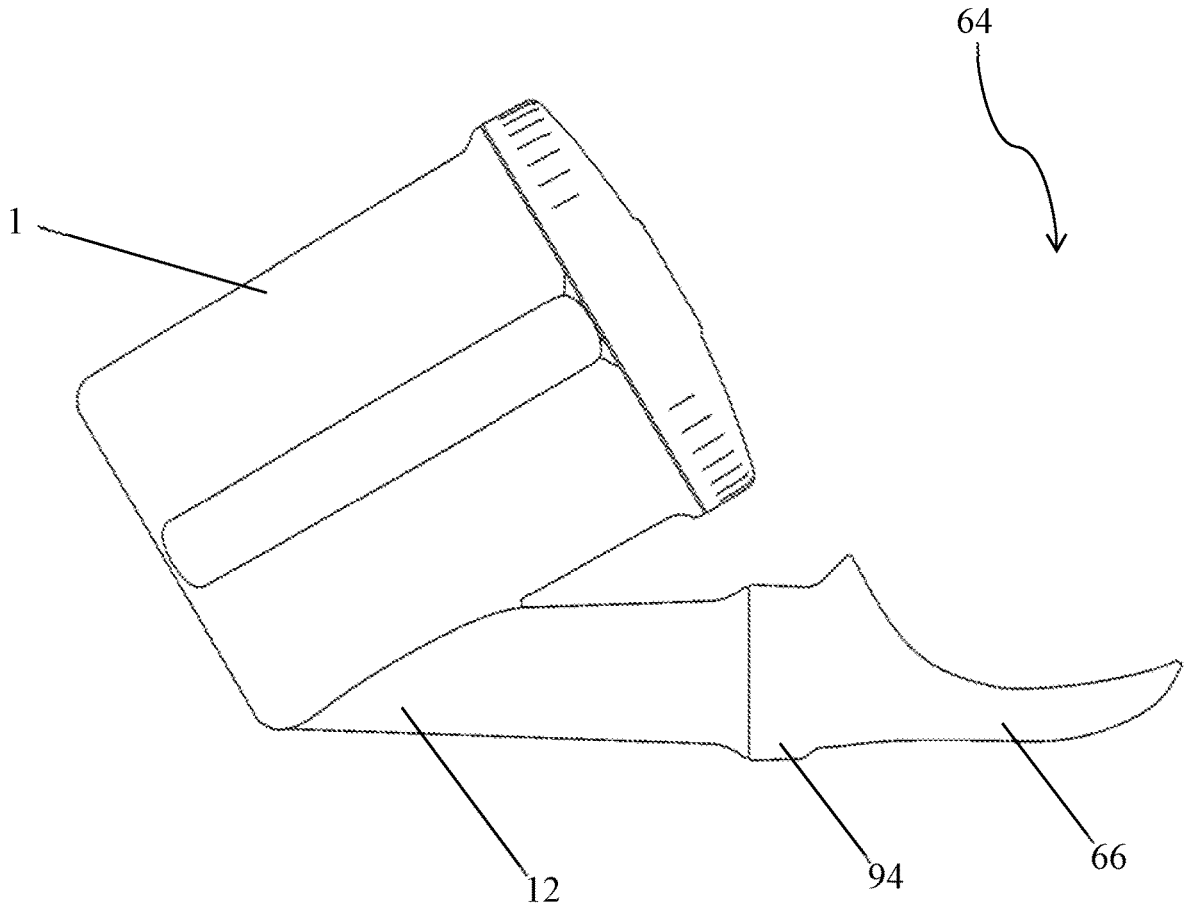
FIG. 4 is a side view of the feeding cup and feeding attachment of FIGS. 2 and 3, tilted as to feed a patient, with the volume in the spoon-part.
Figure 5:
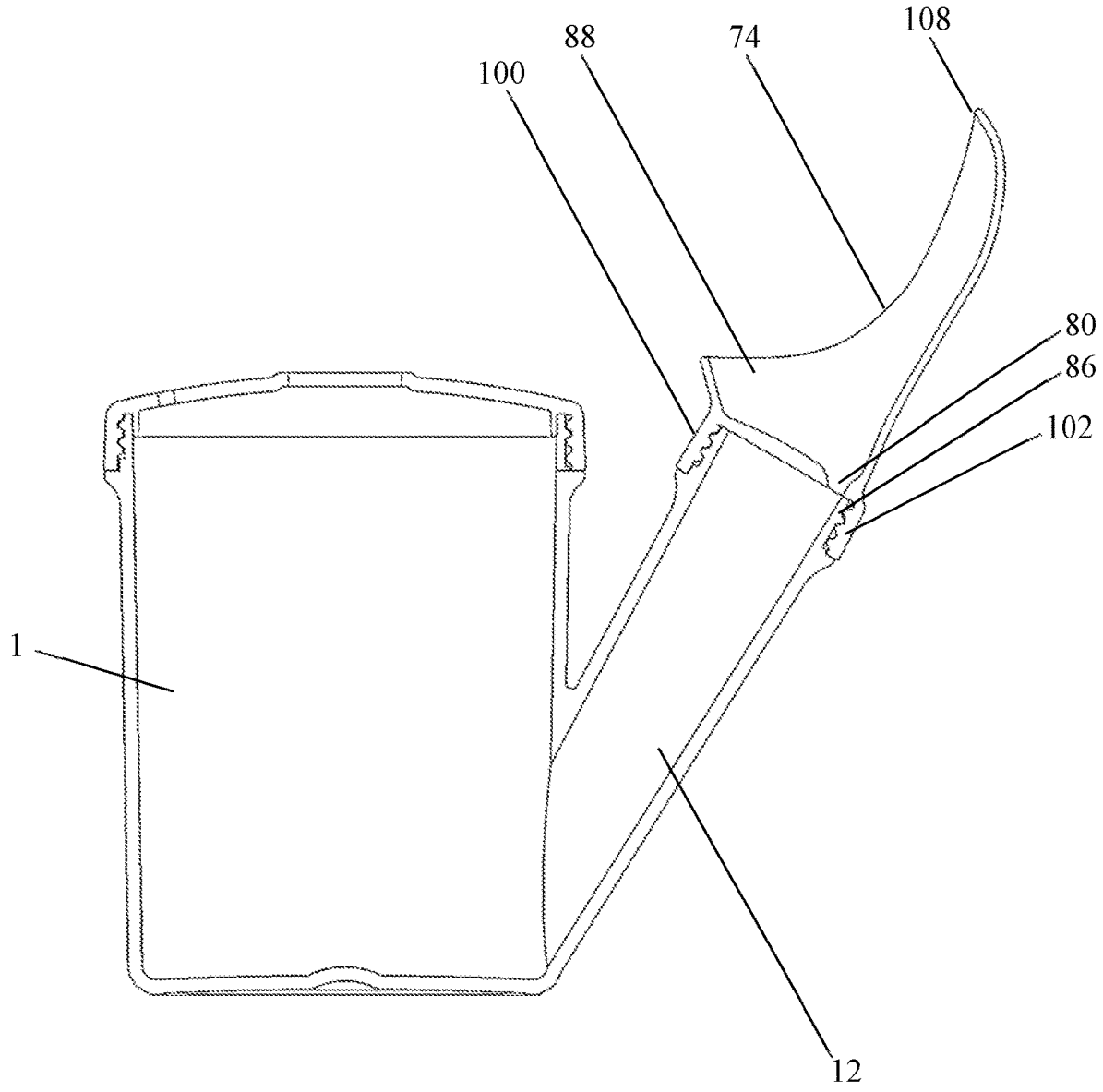
FIG. 5 is a cross-sectional side view of the feeding cup and feeding attachment of FIGS. 2 and 3, flat on a surface.
Figure 6:
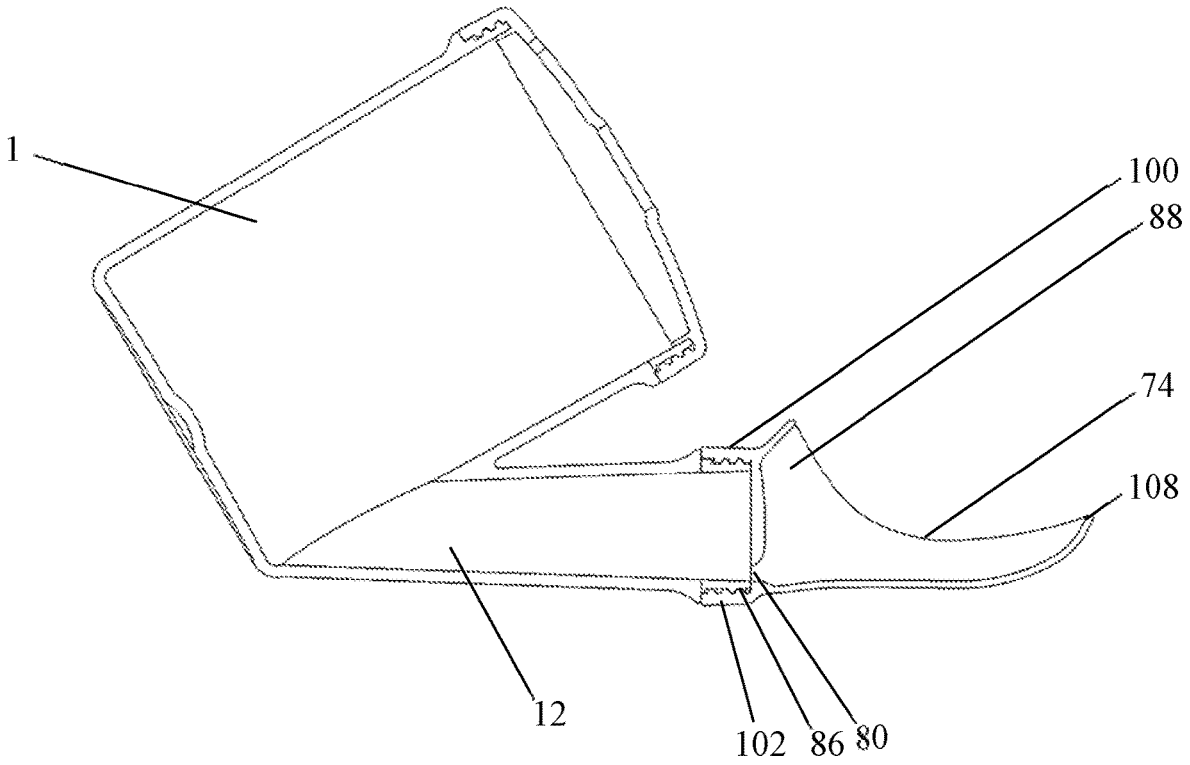
FIG. 6 is a cross-sectional side view of the feeding cup and feeding attachment of FIG. 4, tilted to feed a patient.
Figure 7:
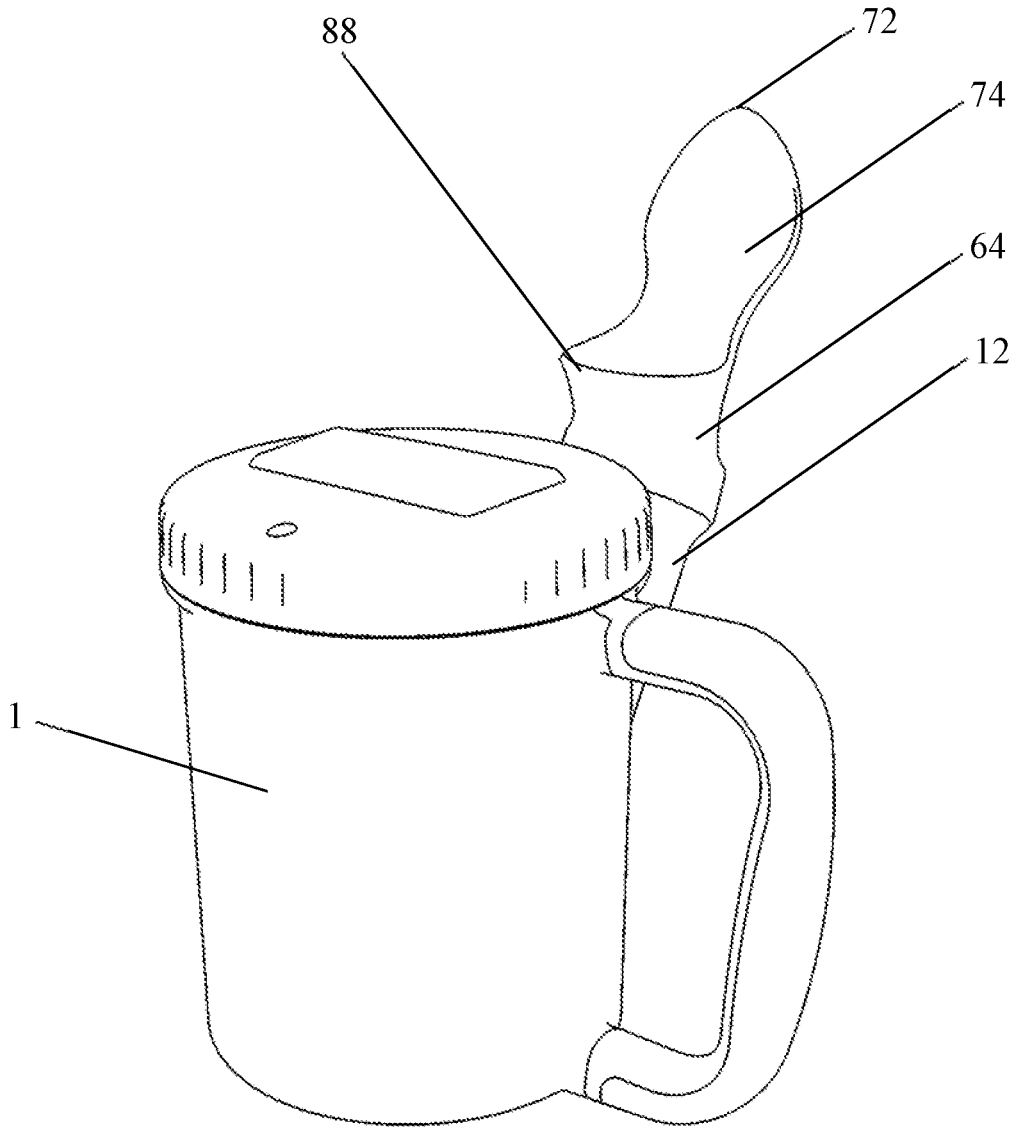
FIG. 7 is a rear perspective view of the feeding cup and feeding attachment of FIGS. 2, 3 and 5, flat on a surface, illustrating the holding cuff arrangement.

Referring to the inventors prior art multi-angle feeding cup of Australian patent application number 2016202017, as illustrated in FIG. 1, multi-angle feeding cup 1, has body 10 and exit channel 12. Exit channel 12 has flexible mouth piece 14 attached with hole 16 to feed thickened liquid food to a patient; the patient, and thickened liquid food is omitted throughout all the Figures, for ease of illustration. The thickened liquid food products are proprietary products of the inventor, sold under the brand NutriTaste (Trade Mark). Use of the proprietary NutriTaste (Trade Mark) is of particular benefit with the invention, and have been developed to work together. Other products could be used instead.

Exit channel 12 is joined at cuff 18 to mouth piece 14 to enable ready removal and interchange of mouth piece 14. Mouth piece 14 is attached with a slot-and-groove arrangement with a triangular connection to cuff 18.

Lid 20 with label 22, and handles 24, 26, 28, and join of 14 to 12 to complete cup 1 to create a fully multi-angle feeding cup that may be inverted and liquid food does not fall out, but can be fed through hole 16 in a safe and controlled manner. In this manner the positional angle of feeding may be any suitable angle, a great benefit when feeding patients. Body 10, exit channel 12, cuff 18 and lid 20 of multi-angle feeding cup 1 are all illustrated made of a rigid plastics material, namely Acrylonitrile Butadiene Styrene ("ABS") to be strong and resistant to damage.

Mouth piece 14 is made of a soft silicone, rating 47 on the Shore hardness scale, as has been found particularly suitable. Mouth piece 14, enables feeding of thickened liquid food to an adult using the "seek, suck and swallow" reflex.

Mouth piece 14 also includes bulb 32, having a suitable thickness of material, as well as the correct size and shape to fit the potential space between the central tongue and hard palate of an average adult mouth. In an elderly patient the tongue may fatigue easily if bulb 32 and other parts of mouth piece 12 are made of a material too strongly resistant. If the material bulb 32 is too soft then there is insufficient propulsion. A firm and effective recoil of bulb 32 is used so that bulb 32 refills with thickened liquid after suction and deposit of the material has occurred. After extensive experimentation, bulb 32 was found to have optimal function where the wall is 1.8 millimetres thick silicone with a shore hardness value of 47. All of mouth piece 14 is made of silicone of this form, and varies only in shape and thickness of wall, for example, the walls at the hole being arranged to create a valve.

Once bulb 32 of mouth piece 14 is in the mouth of the patient it is compressed by the tongue against the hard palate to increase bulb pressure, which is beneficial during feeding. Shaped part 34 of mouth piece 14 is designed to fit and wedge the anterior aspect of the tongue, in use, to assist to feed the patient in a safe, comfortable and efficient manner. Hole 16 at the low pressure end of bulb 32, loses integrity due to thinner walled prolapsing cusps, to facilitate the controlled deposit of the thickened liquid food to the back of the tongue of the patient.

As illustrated mouth piece 14 is coloured green, indicating that hole 16 has a diameter of 0.5 millimetres and is suitable for mildly thick liquids, Level 150. Alternative mouth pieces 14 are also supplied, colour coded to make it quick and easy to find an appropriate mouth piece 14 to use with the particular thickness of liquid. Where mouth piece 14 is purple silicone, this indicates that hole 16 has a diameter of 1 millimetres and is suitable for moderately thick liquids, Level 400. Similarly, where mouth piece 14 is blue, this indicates that hole 16 has a diameter of 2 millimetres and is suitable for extremely thick liquids, Level 900. Clearly, these colours can be varied, and different manners of indicating the type of mouth piece 14 used instead. These colours have been adopted by Australian Standards as standardised with the levels of thickness to facilitate the correct use by carers.

Handles 24, 26, and 28 run from base 42, towards lid 20, to allow comfortable and easy holding. Base 42 is a flat, stable base ensuring maximum stabilisation of cup 1 when placed on a surface to minimise accidental tipping over.

Use of multiple handles 24, 26 and 28 gives more options to hold cup 1, in every direction. The patient may hold handles 24 and 26, for example, and the carer may keep a light hold on handle 28 in care of loss of grip or to assist with tilting. The carer may hold any one of handles 24, 26 or 28 or more if convenient in order to feed the patient at any angle or position.

Pressure hole 36 is included in lid 20, to relieve pressure that may be created in body 10 of cup 1, in the usual fashion.

A speech therapist, dietician or other health care professional may prescribe use of a particular level of thickness of food and so the associated mouth piece 14. Introduction of standardised systems and formulas in this regard assist to follow through on these prescriptions for the best feeding outcome for the patient.

Premix formulas provided by the inventor's company or others are intended to be adjusted to comply with the three levels of thickness and the three mouth piece 14 configurations. A colour co-ordinated approach to the packaging for the premix makes the system simpler again, and for the instructions for the particular thickness. For example, 50 grams of a premix formula of Level 2 mixed with 250 millilitres of water should exactly suit the standardised thickness level of Level 2, Level 400 moderately thick. In this way, the premixed liquid food Level 400, should comply perfectly with use of the inventive multi-angle cup 1, with purple mouth piece 14, having hole 16 with a 1 millimetre diameter. In another example, 50 grams of a premix formula of Level 1 mixed with 250 millilitres of water should exactly suit the standardised thickness level of Level 1, Level 150 mildly thick and so would be used with green mouth piece 14 having hole 16 with 0.5 millimetre diameter. Likewise blue mouth piece 14 would be used where the premix formula is made up according to the instructions to level 3, Level 900 extremely thick. Clearly, the instructions, proportions and colours can be varied.

Use of a standardised safety protocol (the "Safety Protocol") directly before feeding the patient is most preferred and will proceed as follows:

Step 1: Professional prescription of use of suitable mouth piece size and premix at the thickness level desired;

Step 2: Selection of the appropriate mouth piece 14 and premix; these are colour coded and coordinated for quick and easy selection;

Step 3: Mix and shake 50 grams of premix in a shaker with 250 millimetres of water for 30 seconds until smooth and well mixed;

Step 4: Pour mixed thickened liquid food mixture into body 10 of cup 1;

Step 5: Seal by screwing on lid; Step 6: Fit appropriate size of mouth piece 14 by screwing on cuff 18;

Step 7: Tip cup 1 so mouth piece 14 is pointing vertically down over a receptacle for a few seconds so that the liquid food enters exit channel 12;

Step 8: Observe for 10 seconds to ensure that no liquid exits hole 16;

Step 9: Milk mouth piece 14 by pulling between two fingers in a downward motion to expel the content of mouth piece 14 onto the plate while in the downward orientation; and Step 10: Observe for a further 10 seconds to ensure that no further liquid exits hole 16.

As described fluid flow is strictly controlled so that only on the milking of mouth piece 14 will fluid flow and no dribbling or dripping should occur once the milking action has ceased. The milking action, in use, is caused by use of the seek, suck and swallow reflex elicited in the patient. It is most beneficial that the flow is so precisely controlled, so that it can be stopped immediately, if need be, without additional flow. In this, the prior art cup and feeding attachment is adapted to carefully control the flow and volume for safe feeding.

The following describes alternative feeding attachments that have been developed for use to improve the feeding outcome for a particular patient. For example, where the patient is assessed as having early or intermediate dysphagia, rather than a more advanced grade.

Referring to FIGS. 2 to 9, a first preferred embodiment of the invention will be described, where feeding cup 1 is the feeding cup of the prior art of FIG. 1, with a different, inventive feeding attachment used. The reference numerals used for feeding cup 1 are the same as used to describe FIG. 1. These reference numerals to the feeding cup are the same for each of the embodiments. To reiterate, feeding cup 1 has body 10 and exit channel 12. It is to and about exit channel 12 that the inventive feeding attachment is attached for use for early stage dysphagia as described in more detail below. Mouthpiece 14 and cuff 18 are replaced in the new form of the invention. However, label 22, handles 24, 26 and 28 are included, as is base 42, and grips 44, 46 and 48. The description for these is as described for FIG. 1. It is preferably to use the ergonomic and carefully designed feeding cup and exit channel of the earlier invention as shown in FIG. 1, with the inventive feeding attachment of FIG. 2. However, in inferior forms of the invention the feeding cup may be different, having a single handle for example. The attachment of the feeding attachment is a screw fit between the upper most part of exit channel 12 and feeding attachment 64, as would be readily understood by a person skilled in the art.

Feeding attachment 64 has spoon part 66 and neck 68. The overall shape of the spoon part is suitable to be used by a patient as a spoon but has numerous design aspects to enable a patient with early stage dysphagia to safely use and feed from the apparatus.

The spoon like shape is more acceptable to patients with early stage dysphagia and so is a good introduction to use of the feeding cup. Opening 70 enables the thickened liquid food to be fed without the hyperextension of the neck, which can be a serious problem in these patients.

Figure 8:
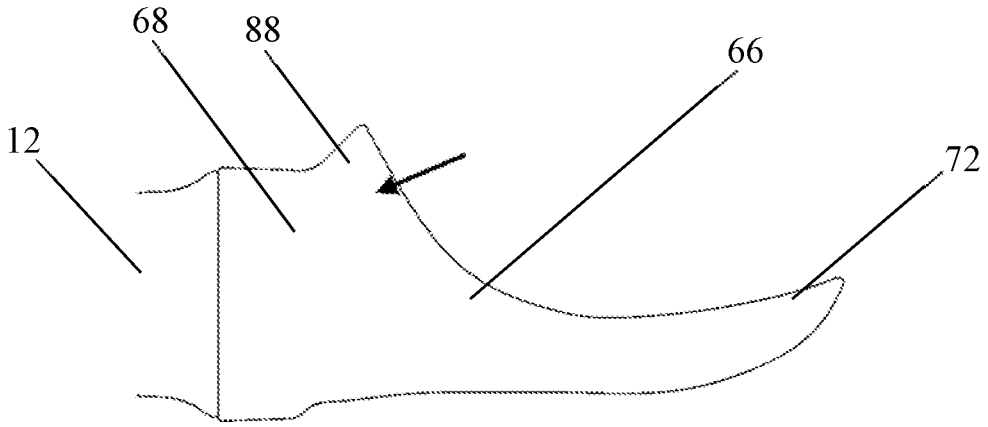
FIG. 8 is a detailed side view of the feeding attachment of FIGS. 2 to 7 illustrating the spoon-part and cuff.

As can be seen in particular in FIG. 8, the internal mechanism of inventive feeding attachment 64 has been carefully designed to provide a vastly improved means of feeding those with early stage dysphagia. Spoon part 66, of feeding attachment 64, has tip 72, bowl 74 and floor 76 for receipt of thickened liquid food from exit channel 12. Wall 78 provides some control over the flow with flow enabled through curved slit 80 to assist in flow management as described below. Without some degree of control, free flow of the thickened liquid food would make feeding difficult, and lead to spillage and mess. Corresponding sides 82 and 84 are also shown in FIG. 8 as part of the screw fit to exit channel 12. A push fit or other means to readily attach and detach feeding attachment 64 could be used instead. The attachment is firm once in place so that feeding can take place confidently.

As mentioned above, drinking out of a normal cup imposes the problem of high-risk neck extension for the patient with dysphagia. The patient has to extend the neck to empty the cup, particularly difficult if drinking thickened liquid foods, and towards the bottom of the cup. The subject invention introduces the use of a feeding attachment 64, to exit channel 12 of the Rose-Cup (Trade Mark) cup 1. The spoon like attachment enables a patient with early stages of dysphagia to use a spoon-method of feeding thickened fluids in a constant drinking action, importantly without extending the neck. The spooning is a familiar action and has none of the stigma attached to suck or sip feeding.

Figure 9:
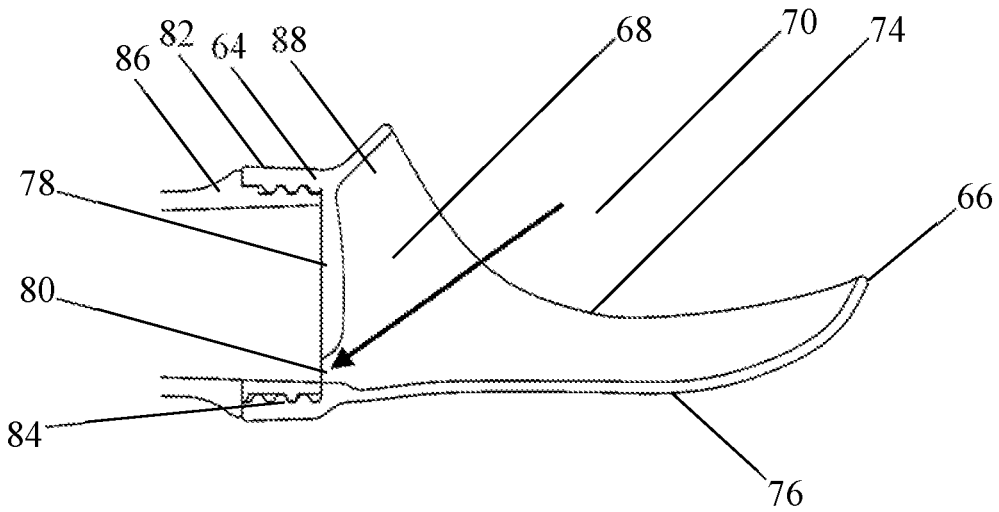
FIG. 9 is a cross-sectional side view of the feeding attachment of FIG. 8.

Feeding attachment 64 is attached as shown, by a simple screw-on mechanism using corresponding sides 82 and 84 gripping corresponding parts of the end of exit channel 12, refer FIG. 9.

Feeding attachment 64 is designed for the ideal situation where:

The patient sitting in the normal feeding position at the table

The patient has good coordination and muscle strength

The ideal intake is Level 1 thickened fluids

The design of feeding attachment 64 was made to specifically accommodate the flow-dynamics of Level 1 thickened fluids. Minor adjustments to the basic design would effectively deliver other levels of thickened fluids as well. There are 3 basic design elements that ensures the affectivity of the spoon delivery mechanism of Level 1 thickened fluids, a curved slit, the length of the neck and height of the edges and the "holding cuff", as will now be described As illustrated by FIG. 9 the exit channel of cup 1 is directed down to a 3×10 millimetre curved slit 80 at the bottom of the inlet, formed by wall 78. An arrow indicates the location of curved slit 80, flow being in from exit channel 12 during feeding. Flow can also slowing occur back into exit channel toward cup 1 if feeding does not take place and cup is tilted back up to be placed on a flat surface, as described further below. The particular design is necessary to prevent an overflow of spoon part 66 by the high volume—slow speed advancing liquid wave.

The length of neck and height of the neck edges, the height and shape of the spoon part edges as well as the overall shape was ergonomically designed to optimal fill with thickened fluid before spill would result at the feeding end of the spoon-part, if no drinking commences; refer FIGS. 8 and 9, in particular.

On interruption of the drinking process, such as by tilting the cup back and placing it back on the table, the volume of thickened fluid already in neck 68 and bowl 74 of feeding attachment 1 would cause spilling of the content due to the slow receding of the high viscosity fluid through the narrow entry slit, curved slit 80. The problem was solved by creating a holding cuff, refer FIGS. 8 and 9 in particular, at the base of the spoon that holds the exact volume of spoon bowl 74 when in the tilted position when tilted up, such as when the cup is set down on a flat surface. Cuff 88, indicated by an arrow on FIG. 8, widens or balloons slightly to hold the required volume while limiting edge height to prevent interference with the nose, when being used to feed. When cup 1 is placed with base 42 on a table, the high viscosity liquid is pooled in cuff 88 to allow the slow migration of the thickened fluid back into cup 1. The flow will be slow of the thickened liquid food, but gradually will flow back in the direction indicated by the arrow on FIG. 9 from cuff 88 through curved slit 80. The arrangement assist to prevent waste of the measured volume of thickened liquid food, prevents mess, as well as carefully enabling patients with early stage dysphagia to feed without the risks associated with use of a standard spoon feeding or drinking as outlined above.

Figure 10:
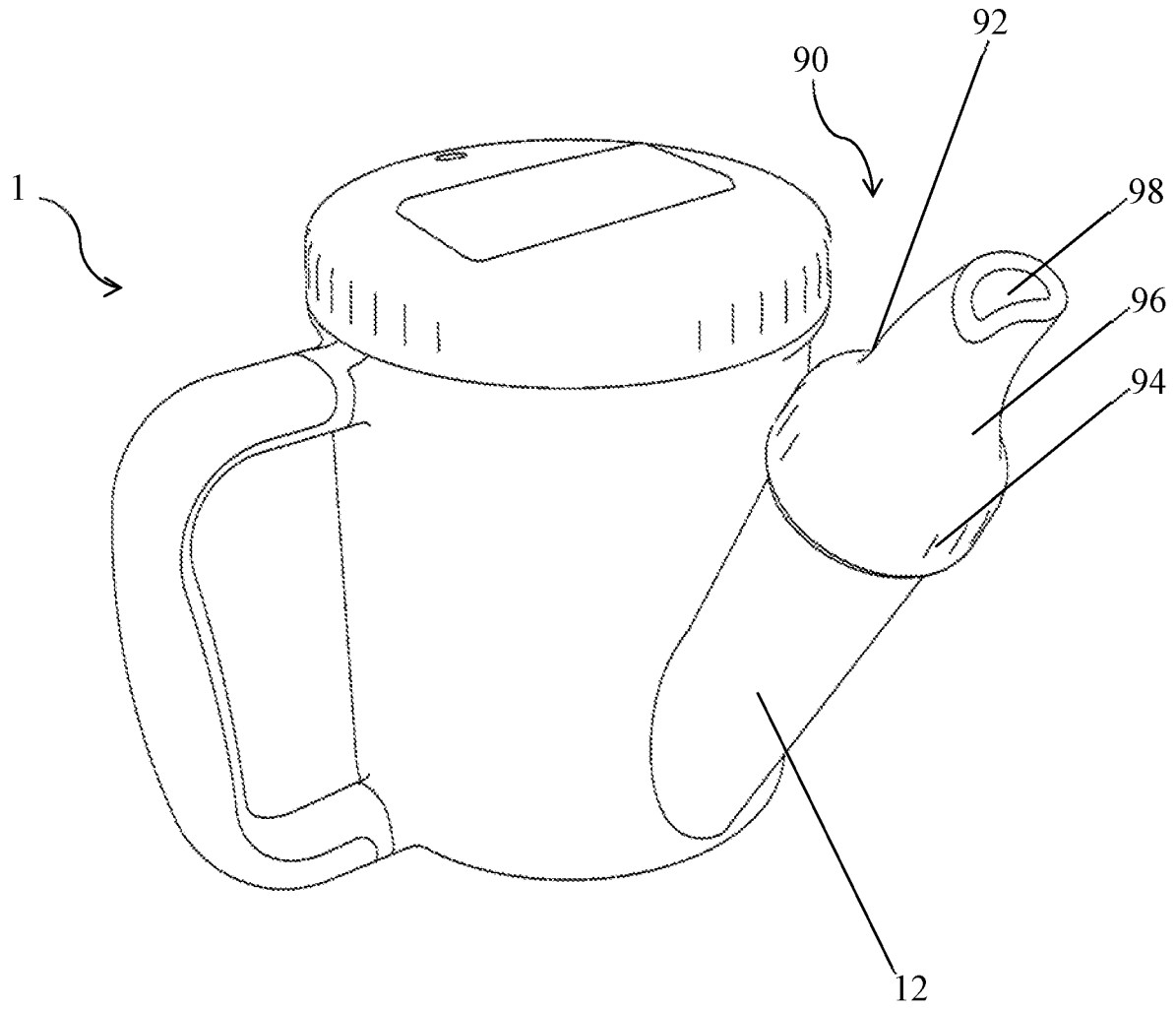
FIG. 10 is a perspective view from above of a feeding cup and feeding attachment according to a second preferred embodiment of the invention.
Figure 11:
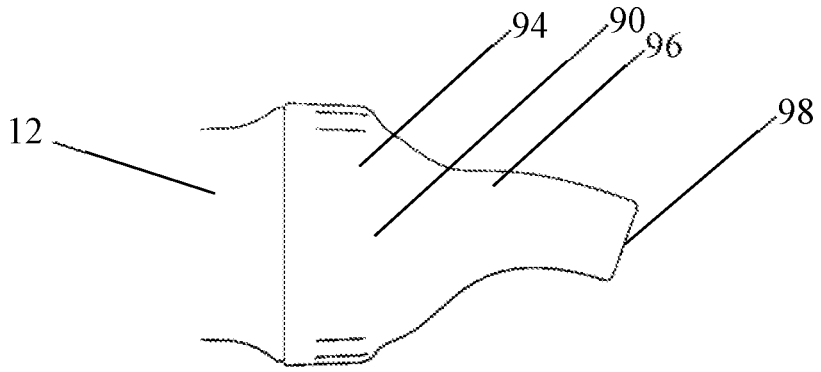
FIG. 11 is a detailed side view of the feeding attachment of the second preferred embodiment of FIG. 10.
Figure 12:
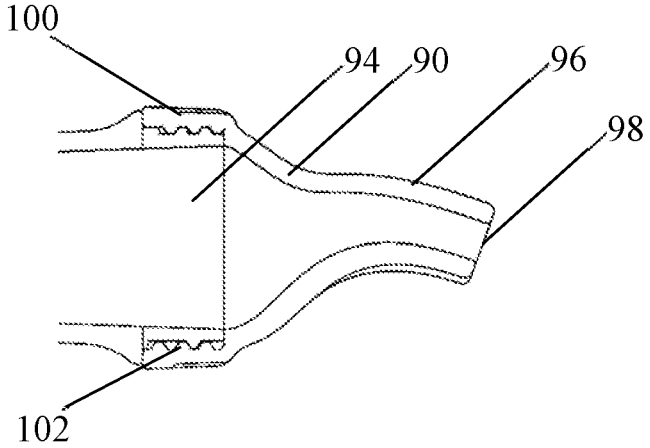
FIG. 12 is cross-sectional side view of the feeding attachment of FIG. 11.
Figure 13:
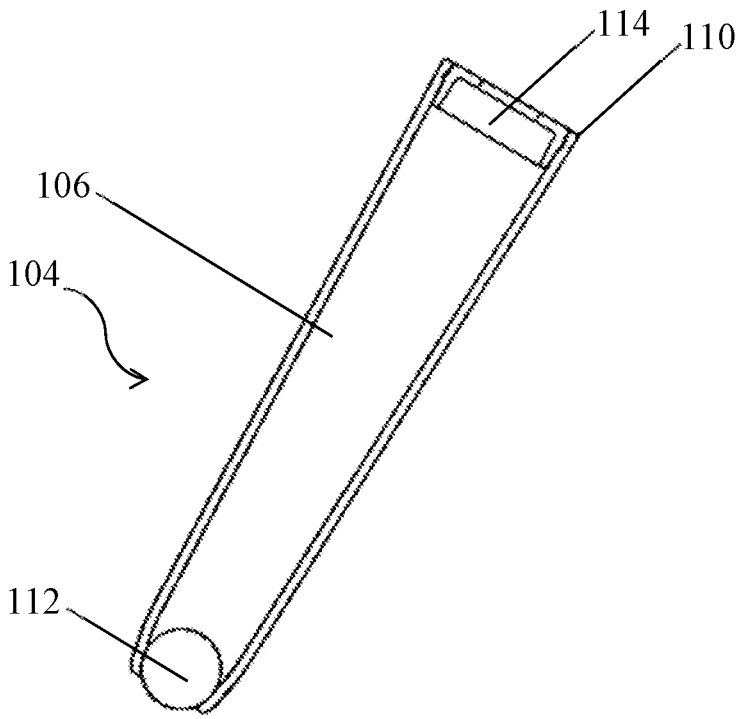
FIG. 13 is a detailed side view of a valve used with the feeding attachment of FIGS. 10 to 12 with the ball valve closed.
Figure 14:
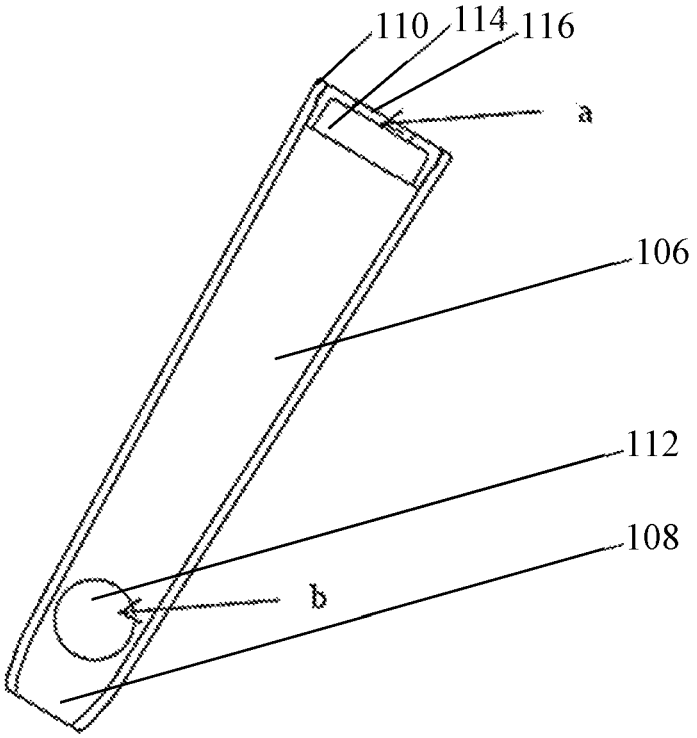
FIG. 14 is a detailed side view of the valve of FIG. 13 with the ball-valve open.
Figure 15:
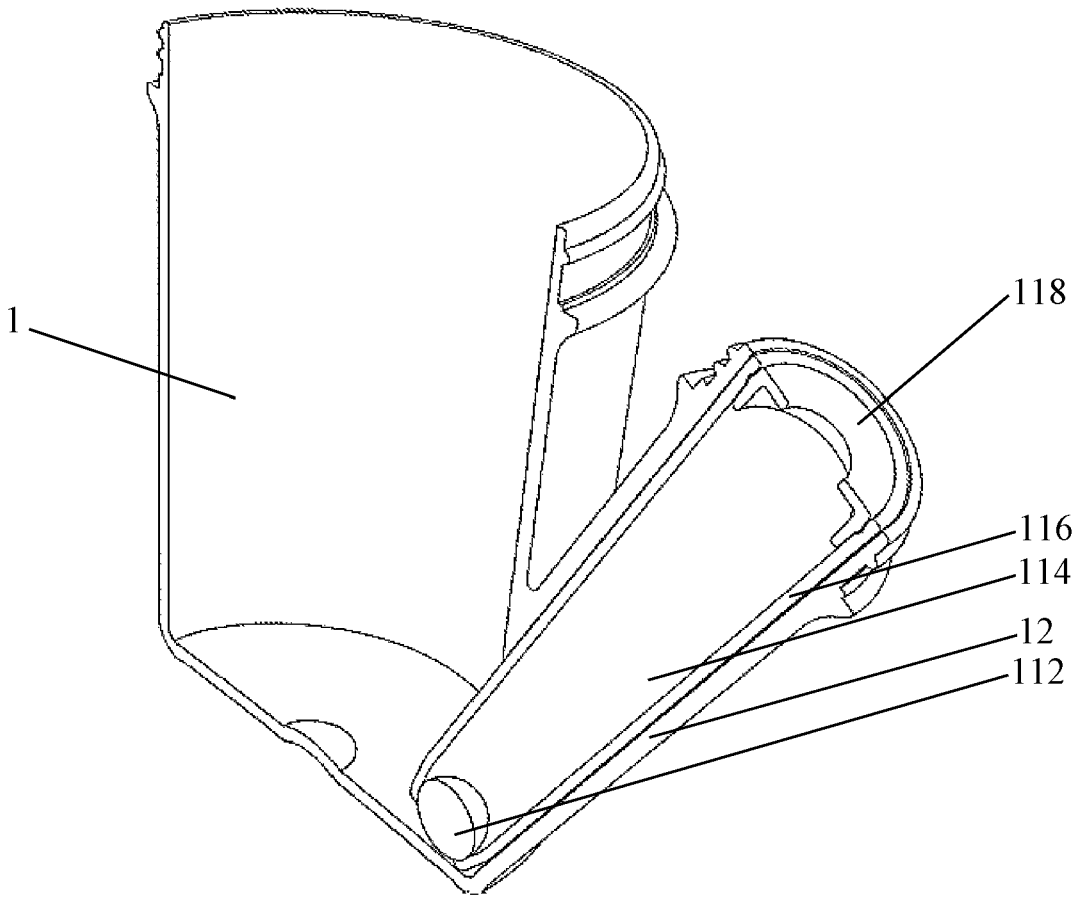
FIG. 15 is a cross-sectional perspective view of the feeding cup of FIG. 10 showing the valve of FIGS. 13 and 14 installed in the exit channel, and the ring stopper to prevent loss of the ball.
Figure 16:
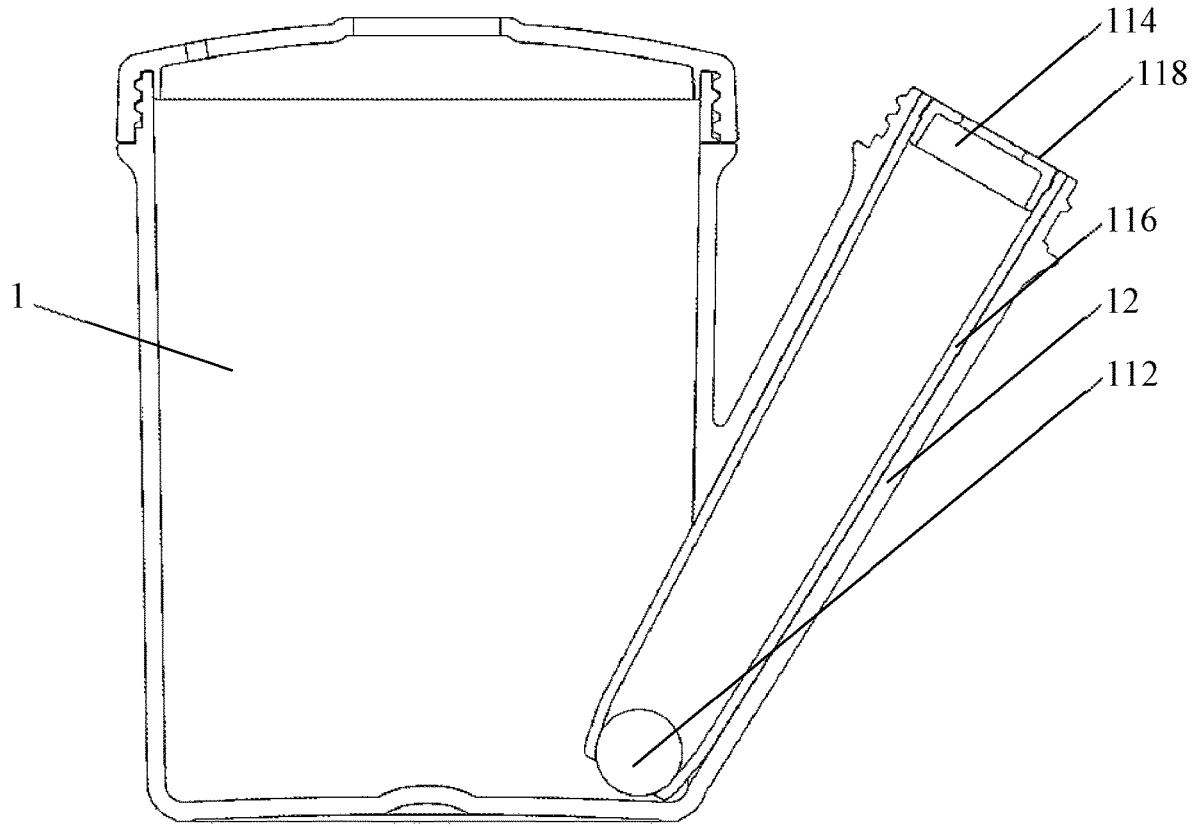
FIG. 16 is a cross-sectional side view of the feeding cup of FIG. 15, illustrating the closed ball valve.
Figure 17:
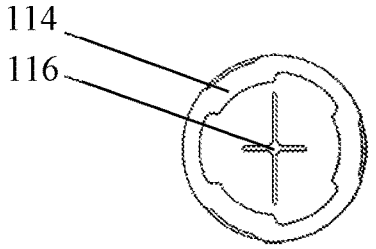
FIG. 17 is a detailed plan view of the a cusp valve part of the valve arrangement of FIGS. 10 to 16.
Figure 18:
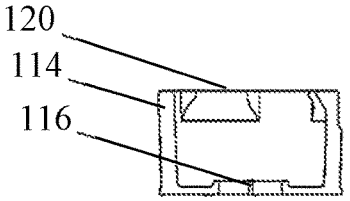
FIG. 18 is detailed side view of the cusp valve part of FIG. 17.
Figure 19:
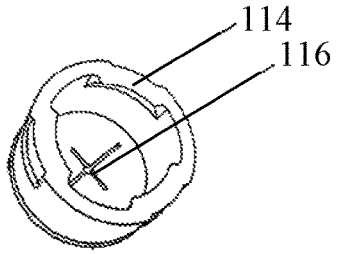
FIG. 19 is a detailed perspective view of the cusp valve part of the valve arrangement of FIGS. 17 and 18.
Figure 20:
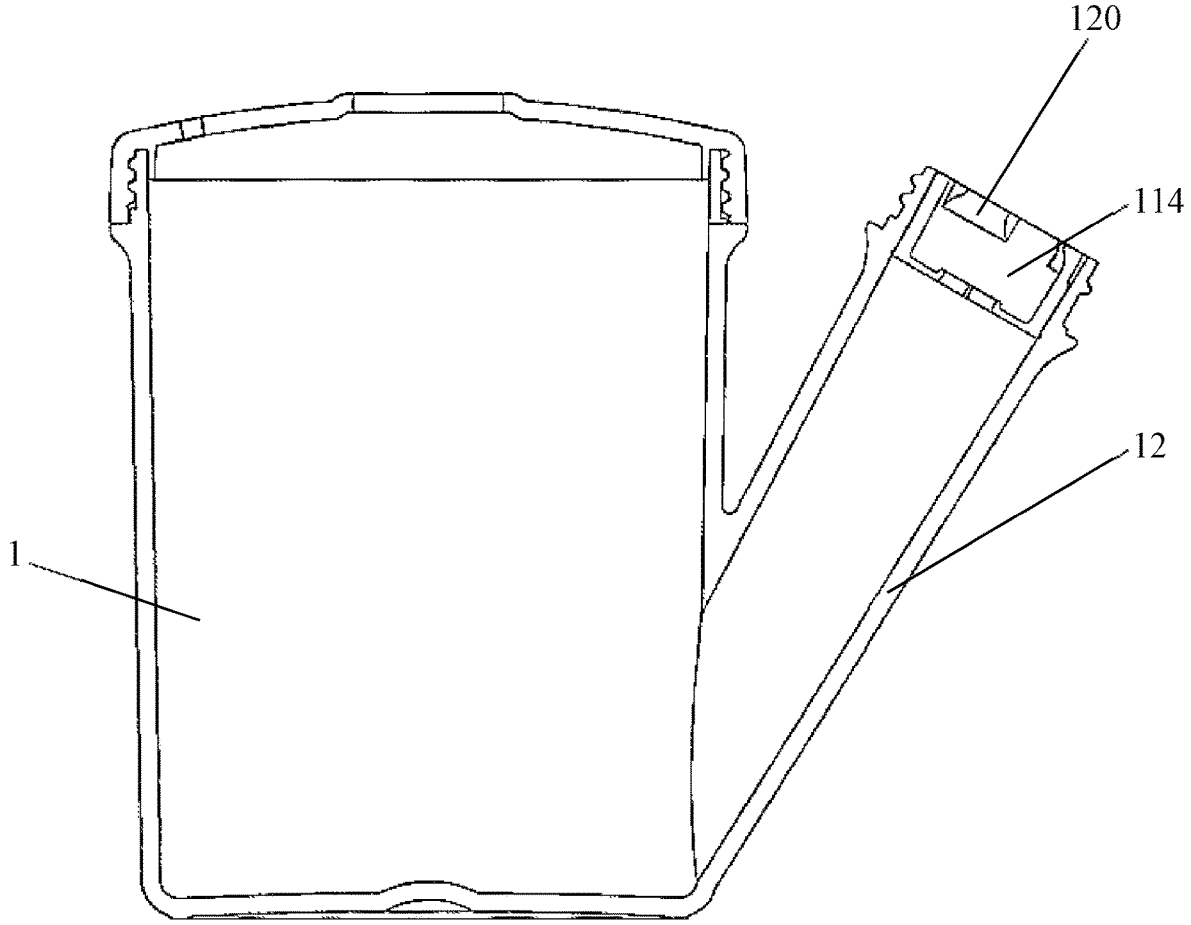
FIG. 20 is a cross-sectional perspective view of a feeding cup with the cusp valve part of FIGS. 17 to 19 installed.
Figure 21:
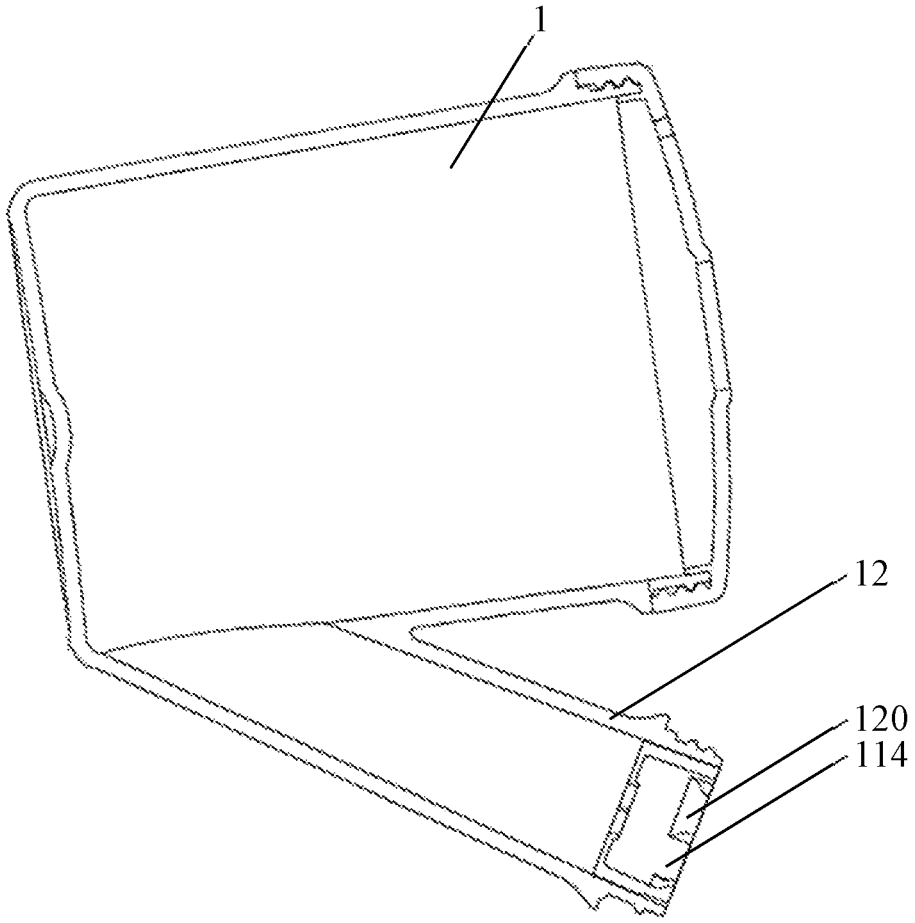
FIG. 21 is a cross-sectional view of the feeding cup of FIG. 20 in a tilted position.

Referring to FIGS. 10 to 12, a feeding attachment 90 also is designed to fit to cup 1, as described with reference to FIG. 1, prior art, and FIGS. 2 to 9 with inventive feeding attachment 64. Feeding attachment 90 also fits to exit channel 12 with a screw fit as would be readily understood.

Feeding attachment 90 has body 92 with neck 94, spout 96 and opening 98. Corresponding sides 100 and 102, refer FIG. 12 in particular, enable the screw fit to exit channel 12, as would be readily understood. Free flow of thickened liquid food from cup 1 through exit channel 12 on tipping enables food to be sucked through "lip sucking" by the patient.

It is important to distinguish between lip sucking and tongue sucking. Lip Sucking uses mostly the anterior (front) section of the mouth and tongue to create a negative pressure environment that draws liquid into the anterior section of the mouth. This action depend largely on Cranial Nerve No V11 (Facial Nerve) that control the facial muscles, including the lips. An example of lip sucking is drinking from a cup using a straw.

Tongue Sucking on the contrary uses primarily the whole tongue to create a negative pressure environment in the central and posterior (back) sections of the mouth that draws liquid into the posterior sector of the oral cavity. This action depend largely on Cranial Nerve No X11 (Hypoglossal Nerve) that controls most of the actions of the tongue. An example of tongue sucking is drinking from a bottle by sucking on a soft spout.

However, both methods of sucking depends heavily on the interaction of all 6 cranial nerves involved in eating, drinking and swallowing as well as voluntary nerves, reflex circuits and more than 30 muscles.

"Sipper cups" designed for drinking normal liquids from a small spout attached to a cup is used extensively by young children as well in Aged Care. This method of drinking utilises the lip suck method. The spouts are too small to deliver thickened fluids effectively. Taking fluids out of a "Sipper Cup" requires neck extension for effective delivery, with all the associated problems. Clearly it is highly undesirable for the patient to hyperextend their neck in order to feed in this manner.

Feeding attachment 90 was designed to screw onto the end of exit channel 12 of cup 1, as illustrated in FIGS. 10 to 12. This attachment is specifically designed for delivering thickened fluids to the adult mouth as per lip-suck mechanism. The sipper body is wide and curved to ergonomically fit the tongue tip and lips of the adult mouth with comfort. The wide exit of about 4×10 millimetres easily allows the free flow of thickened fluids. Use of the attachment allows comfortable feeding in the sitting position without neck extension. Feeding attachment 90 for cup 1 is specifically designed for the early and intermediate stages of dysphagia. It should be socially more acceptable than the tongue suck attachments, in these early stages. The design depends on effective lip suck capabilities of the patient. The basic design does not introduce any flow- or volume control measures. Feeding attachment 90 eg the basic sip attachment has to be considered a high-risk device if utilised in the later stages of dysphagia.

Referring to FIGS. 13 to 21, a valve arrangement 104 is described for use with feeding attachment 90. Clearly, where other forms of feeding attachment is used valve arrangement 104 may also be used. Again valve arrangement 104 is described with cup 1 of the prior art and used with the first and second embodiments of feeding attachment as described above. The same reference numerals are used for FIGS. 13 to 21 for cup 1, for clarity.

Valve arrangement 104 includes body 106 with tip 108 and top 110. Tip 108 is home to ball 112 and top 110 also includes valve 114. Valve arrangement 104 has been carefully designed to control the flow of thickened liquid food in a useful arrangement with cup 1 and feeding attachment 90. Valve 114 includes cross-slit 116 through which thickened liquid food can pass from exit channel 12 into feeding attachment 64 (not shown), to control the flow of thickened liquid food. Ring valve 118 is included, labelled "a" on FIG. 14 to prevent ball 112 accidentally leaving valve arrangement 104. Edges 120 of cusp valve 114 enable easy removal from exit channel 12 through use of the fingers.

In the middle and late stages of dysphagia (Grade 2-3) a further 2 categories of patients are addressed with this edition of device development that is, the introduction of valves. Firstly the patient who still experience significant resistance to engage with a tongue suck device due to perceived social stigmatisation. Secondly as an alternative to normal spoon-feeding to the middle and late stages of patients with pseudo bulbar palsy (Cranial Nerve IX, X & X11 deficit). The latter category is specifically expressed by difficulty in effective movement of the tongue but also include a global oro-pharyngeal paresis (poor muscle function). The predicament implicates an inability/poor ability to utilise the soft spouted tongue-suck option of feeding cup 1 and feeding attachment 90 while the patient still demonstrate some capacity to swallow. Utilising this option presumes a functional Cranial Nerve VII (Facial nerve) controlling lip and facial muscle action.

Both valves are introduced as an option to use in conjunction with feeding cup 1 and feeding attachment 90. These optional valve installations introduce an improvement in the safety profile of the feeding attachment 90. The introduction of valves control flow only—NOT volume. No flow/very little flow will eventuate unless lip-suck is effectively executed and will seize when the negative pressure is cancelled. The only volume control would be implemented by the anatomical spatial limitations of the physiological negative space created in the anterior sector of the mouth during the lip-suck process. We suspect that this might constitute sufficient volume control for safe feeding. It might even be that further/external volume control would be confusing and might not add any real safety benefits—perhaps even have an adverse effect on feeding efficiency.

The ball-valve option also improves ease of feeding by retaining a volume of thickened fluid in the exit canal that helps to relieve muscle fatigue. Muscle fatigue is a common symptom in dysphagia involving the muscles involved in swallowing.

The basic design elements of the optional Ball-Valve installation comprises:

- A tube-like frame that tapers towards tip 108 with a 2 degrees inward slant on the walls which matches and fits into the tapered exit channel 12 of cup 1.
- Tip 108 of the valve-tube is further tapered to contain a 12 millimetre steel ball in the tube (Item b).
- Ring-stop 118 clicks into to base of the valve tube to further contain the steel ball 112.
- The Sip Attachment screws onto end of the exit channel 12 to hold the valve-tube in place.
- With the cup 1 standing on a level surface lip-suck is applied to the Sip mouthpiece and thickened fluid (Typically Level 1) is sucked into the valve tube from the base of the cup. The steel ball moves upward from the tip, fluid swirls around the ball and exit through the hole at the base of the valve-tube to enter the mouth via the Sip Attachment.
- The valve can be manually inserted and removed as a whole for cleaning and storage purposes at any time of choice.

Application: The combination of the Ball-Valve option together with the Sip Attachment give the dysphagia patient with lip-suck capabilities the opportunity to drink while sitting at the table with the cup placed upright on the surface of the table. This option of drinking against gravity assist with poor muscle power of the arms and hands, muscle fatigue, poor coordination, tremors, etc. This option also helps with poor muscle power and muscle fatigue of the facial and oral muscles, by locking the thickened liquid column in the exit channel against the effects of gravity. After a pause/rest the thickened liquid should still be present in feeding attachment 90—ready to be mobilised with low effort lip-suck action.

The basic design elements of the optional Cusp-Valve installation comprises out of the following:

- A cup-shaped valve is constructed i.e. from silicone
- A cross incision in the base of the valve create 4 cusp valves. The thickness, shore value, optimal resistance to prolapse and recoil has been carefully crafted to best suit the behaviour of Level 1 thickened fluid.
- The valve fit firmly into the end of the cup exit and is hold in position by the Sip Attachment.
- The open end of the valve faces the Sip Attachment. The edge is fitted with ledge extensions to allow a fingertip to easy grip and remove the valve for cleaning or replacement purposes.

The combination of the Cusp-Valve option together with the Sip Attachment give the patient with dysphagia that still has lip-suck capabilities, the opportunity to drink out of the RoseCup (Trade Mark) cup 1 while sitting in the reclined position. The exit channel would then be horizontal or pointing downward with no need to extend the neck of the patient. The valve assists to keep flow under control when drinking in synergism with the force of gravity. Thickened fluid (Typically Type 1 Thickened Fluid) will only be released into the oral cavity when the valves and thickened fluid in the exit channel are exposed to a sufficient negative pressure gradient created in the mouth (lip sucking). When the negative pressure is cancelled during a pause/rest, the cusps will close and flow will cease. This mechanism should assist with the safe feeding of the patient with dysphagia. As explained above this mechanism controls flow only and relies on the anatomical dimensions of the anterior oral cavity dedicated to the creation of the negative space, to control volume.

The invention in various forms is highly beneficial and gives carers and health workers a great range of options. Overall the invention is a significant improvement for patients with early or intermediate stage dysphagia, in particular, and as an option for introduction to the use of the RoseCup (Trade Mark).

It will be apparent to a person skilled in the art that changes may be made to the embodiments disclosed herein without departing from the spirit and scope of the invention, in its various aspects.

REFERENCE SIGNS LIST

| | |
|---|---|
| 1 | Feeding Cup |
| 10 | Body of Cup |
| 12 | Exit channel |
| 14 | Mouth piece |
| 16 | Hole in mouth piece |
| 18 | Cuff |
| 20 | Lid |
| 22 | Label for lid |
| 24 | Handle |
| 26 | Handle |
| 28 | Handle |
| 30 | Join of 14 to 12 |
| 32 | Bulb of 14 |
| 34 | Shaped part of 14 |
| 36 | Pressure hole |
| 38 | |
| 40 | |
| 42 | Base |
| 44 | Grip of 24 |
| 46 | Grip of 26 |
| 48 | Grip of 28 |
| 50 | Endplate of 14 |
| 52 | Cusp |
| 54 | Cusp |
| 56 | Cusp |
| 58 | Cusp |
| 60 | Anchoring point |
| 62 | Cut |
| 64 | Feeding attachment |
| 66 | Spoon part |
| 68 | Neck |
| 70 | Opening |
| 72 | Tip of 66 |
| 74 | Bowl of 66 |
| 76 | Floor |
| 78 | Wall |
| 80 | Curved slit |
| 82 | Corresponding sides |
| 84 | Corresponding sides |
| 86 | Screw for attachment of 12 |
| 88 | Cuff |
| 90 | Feeding attachment |
| 92 | Body |
| 94 | Neck |
| 96 | Spout |
| 98 | Opening |
| 100 | Corresponding sides |
| 102 | Corresponding sides |
| 104 | Valve arrangement |
| 106 | Body |
| 108 | Tip |
| 110 | Top |
| 112 | Ball |
| 114 | Cusp valve |
| 116 | Cross-slit |
| 118 | Ring stopper |
| 120 | Edges |

The invention claimed is:

1. A feeding cup attachment including:

a body with a proximal end and a distal end, the body having a substantially spoon shaped portion with a bowl and peripheral rim, the body being adapted to permit contents of within the bowl to be taken by a patient off the distal end, and wherein the rim substantially at the distal end substantially lies within a spoon plane and the proximal-most portion of the rim projects from the spoon plane so as to define a holding cuff proximal of the bowl, wherein the holding cuff is expandable such that in use it may expand as a result of fluid held therein;

attachment means at the proximal end of the body, the attachment means including a tube therethrough terminating at an open end into the bowl, and the attachment means being adapted to attach the feeding cup attachment to a feeding cup with cooperating cup attachment means; and a valve arrangement within the tube adapted to control the flow of a fluid within the tube;

the feeding cup attachment being adapted in use to be selectively tiltable though a tilt plane substantially orthogonal to the spoon plane between one configuration where a fluid in the bowl may be poured off the distal end of the body and in another configuration the fluid in the bowl is retained within the holding cuff.

2. The feeding cup attachment of claim 1, wherein the holding cuff when the spoon plane is tilted towards the vertical defines a volume greater than a fluid holding volume of the bowl when the spoon plane is horizontal.

3. The feeding cup attachment of claim 1, wherein the attachment means defines an attachment axis substantially coaxial with the elongate axis of the tube, and the attachment axis distends proximally from the spoon plane by substantially 45 to 65 degrees and so thereby adapted to attach with a cup attachment means projecting at substantially 25 to 45 to the vertical.

4. The feeding cup attachment according of claim 1, wherein the valve arrangement includes a one-way valve that allows fluid to flow to the bowl but prevents or resists back flow such that in use the valve arrangement is adapted to allow fluid to flow into the bowl and prevent or slow back flow from the bowl.

5. The feeding cup attachment of claim 1, wherein the valve arrangement regulates the flow of fluid therethrough.

6. The feeding cup attachment of claim 1, wherein the attachment means is removably attachable to the cup attachment means.

7. A feeding cup and feeding cup attachment wherein the combination includes:

the feeding cup attachment of claim 1; and a feeding cup including a cup body, cup attachment means and a fluid exit associated with the cup attachment means.

8. The feeding cup and the feeding attachment of claim 7, wherein the cup attachment means projects from a side of the cup body substantially at a base of the feeding cup.

9. The feeding cup and the feeding cup attachment of claim 7, wherein the cup attachment means is substantially at 25 to 45 degrees to the vertical when the base is horizontal.

10. The feeding cup and the feeding cup attachment of claim 7, wherein the fluid exit is tubular that at one end projects from a side of the cup body near a base of the feeding cup and the cup attachment means is at the other end of the fluid exit.

11. The feeding cup and the feeding cup attachment of claim 10, wherein the fluid exit projects at substantially 25 to 45 degrees to the vertical when the base is horizontal.

12. The feeding cup and the feeding cup attachment of claim 10, wherein the fluid exit is curved along its length.

13. The feeding cup and the feeding cup attachment of claim 10, wherein the fluid exit has a transverse cross-sectional dimension of at least 20 millimetres.

14. The feeding cup and the feeding cup attachment of claim 7, wherein the feeding cup attachment and feeding cup are attached together.

15. A feeding cup attachment including:

a body with a proximal end and a distal end, the body having a substantially spoon shaped portion with a bowl and peripheral rim, the body being adapted to permit contents of within the bowl to be taken by a patient off the distal end, and wherein the rim substantially at the distal end substantially lies within a spoon plane and the proximal-most portion of the rim projects from the spoon plane so as to define a holding cuff proximal of the bowl;

attachment means at the proximal end of the body, the attachment means including a tube therethrough terminating at an open end into the bowl, and the attachment means being adapted to attach the feeding cup attachment to a feeding cup with cooperating cup attachment means, wherein the attachment means defines an attachment axis substantially coaxial with the elongate axis of the tube, and the attachment axis distends proximally from the spoon plane by substantially 45 to 65 degrees and so thereby adapted to attach with a cup attachment means projecting at substantially 25 to 45 to the vertical; and a valve arrangement within the tube adapted to control the flow of a fluid within the tube;

the feeding cup attachment being adapted in use to be selectively tiltable though a tilt plane substantially orthogonal to the spoon plane between one configuration where a fluid in the bowl may be poured off the distal end of the body and in another configuration the fluid in the bowl is retained within the holding cuff.

16. The feeding cup attachment of claim 15, wherein the holding cuff when the spoon plane is tilted towards the vertical defines a volume greater than a fluid holding volume of the bowl when the spoon plane is horizontal.

17. The feeding cup attachment according of claim 15, wherein the valve arrangement includes a one-way valve that allows fluid to flow to the bowl but prevents or resists back flow such that in use the valve arrangement is adapted to allow fluid to flow into the bowl and prevent or slow back flow from the bowl.

18. The feeding cup attachment of claim 15, wherein the valve arrangement regulates the flow of fluid therethrough.

19. The feeding cup attachment of claim 15, wherein the attachment means is removably attachable to the cup attachment means.

* * * * *